United States Patent [19]

Anderson

[11] 4,307,768

[45] Dec. 29, 1981

[54] ENERGY CONSERVING INSULATIVE WINDOW SHADE

[75] Inventor: John J. Anderson, Ramsey, N.J.

[73] Assignee: Anmar Industries, Inc., Hackensack, N.J.

[21] Appl. No.: 215,710

[22] Filed: Dec. 12, 1980

Related U.S. Application Data

[63] Continuation-in-part of Ser. No. 879,356, Feb. 21, 1978.

[51] Int. Cl.[3] ..... A47H 5/00

[52] U.S. Cl. ..... 160/84 R; 428/116; 160/5

[58] Field of Search ..... 160/84 R, 168, 172, 160/238, 266, 269, 271, 273, 5; 24/122.3, 122.6, 129 D, 143 R, 143 A; 428/73, 116, 117, 118

[56] References Cited

U.S. PATENT DOCUMENTS

| | | | |
|---|---|---|---|
| 1,942,989 | 1/1934 | Thomson | 428/117 |
| 2,170,877 | 8/1939 | Simon | 160/271 X |
| 2,477,852 | 8/1949 | Bacon | 428/116 |
| 2,548,041 | 4/1951 | Morse | 160/269 X |
| 2,551,736 | 5/1951 | Guarcello | 160/172 X |
| 2,869,205 | 1/1959 | Kacowski | 24/143 R |
| 3,225,509 | 12/1965 | May | 428/118 |
| 3,231,006 | 1/1966 | Fisher et al. | 160/269 X |
| 3,256,931 | 6/1966 | Öijerholm | 160/84 R X |
| 3,294,151 | 12/1966 | Hartley et al. | 160/5 |
| 3,294,152 | 12/1966 | Kuitvenhover | 160/5 |
| 3,443,860 | 5/1969 | Luboshez | 160/84 R |
| 3,465,806 | 9/1969 | Sulkes | 160/84 R |
| 3,725,981 | 4/1973 | Pickney | 24/127.3 |
| 3,887,739 | 6/1975 | Kromrey | 428/117 |
| 3,899,326 | 8/1975 | Frost et al. | 428/116 |

FOREIGN PATENT DOCUMENTS

| | | | |
|---|---|---|---|
| 6508988 | 1/1967 | Netherlands | 160/84 R |
| 11493 | of 1906 | United Kingdom | 160/84 R |
| 756270 | 9/1956 | United Kingdom | 160/84 R |

*Primary Examiner*—Philip C. Kannan

[57] ABSTRACT

Window shade structure for reducing heat loss or heat gain through a window or other "thermal opening" wherein the shade body is drawable over the window and is collapsible into a reduced storage volume. The shade body comprises opposed walls of thin, sheet-like layers of flexible and resilient material joined together along spaced parallel adhesion lines to form a plurality of contiguous and parallel channels in the shade body. A strip-like sealing slat on the surfaces of the window frame which oppose the edge portions of the shade body, and a slot-like recess formed in the opposite edges of the shade body and extending the full length thereof receive the edge portions and portions of the lateral surfaces of the sealing slat, with the free edges of the sheet-like layers being flexed against the lateral surfaces of the sealing slat to insure against convective air flow and provide an effective convective seal.

22 Claims, 32 Drawing Figures

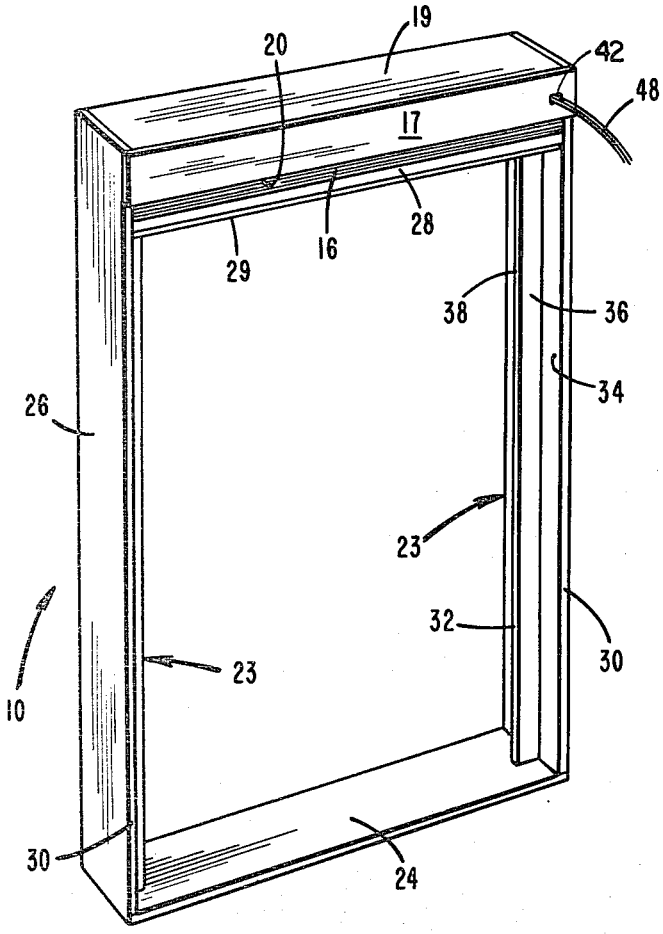
FIG. 4
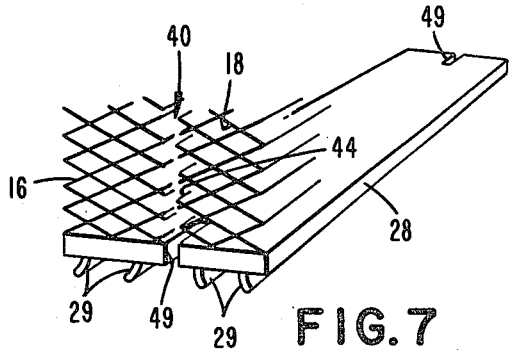
FIG. 7
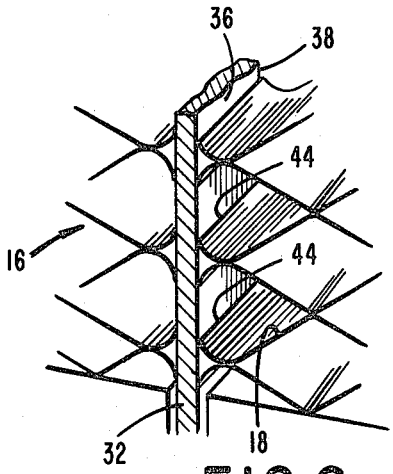
FIG. 6
FIG. 5
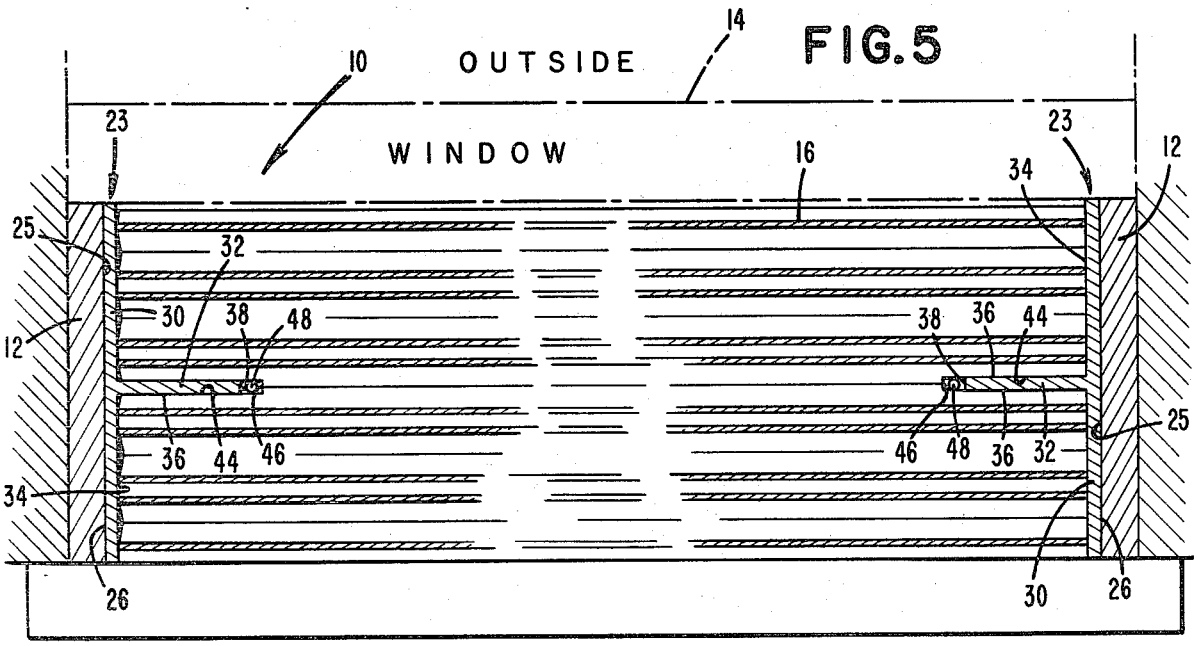

FIG.9a
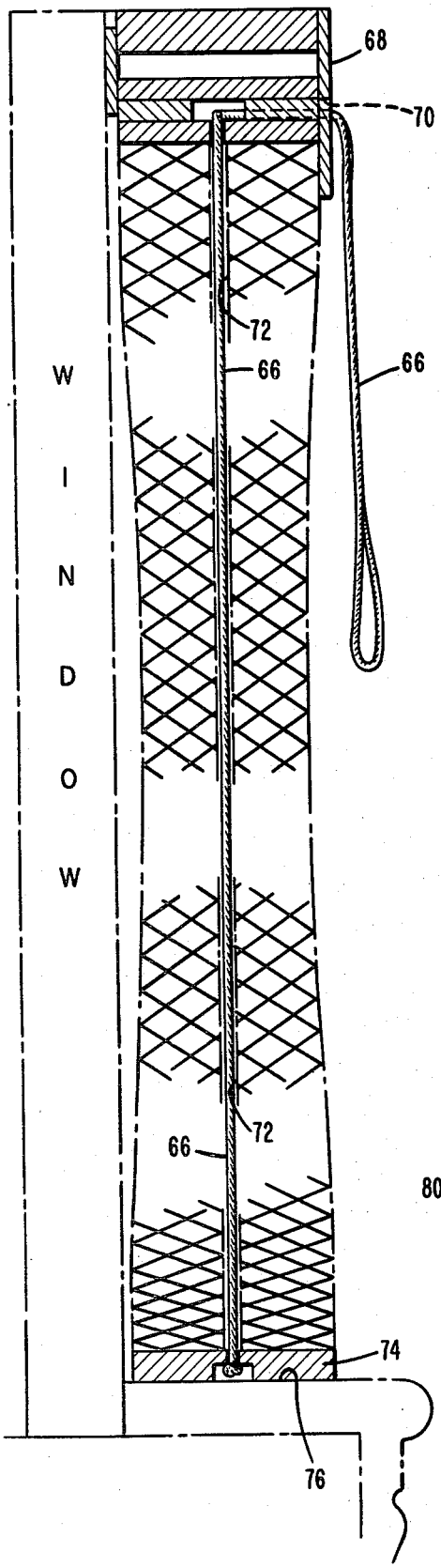
FIG.9b
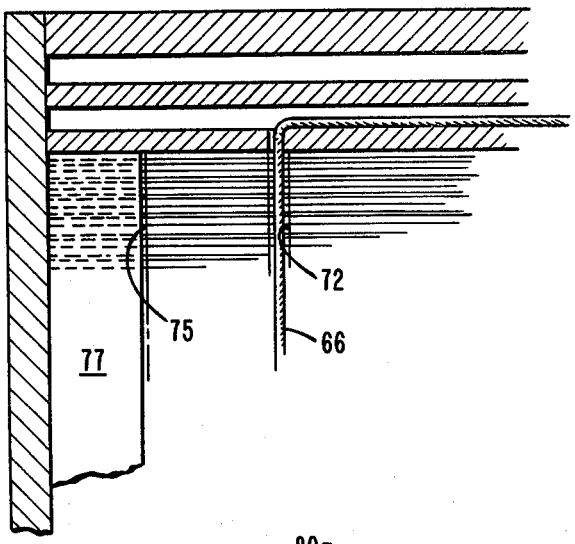
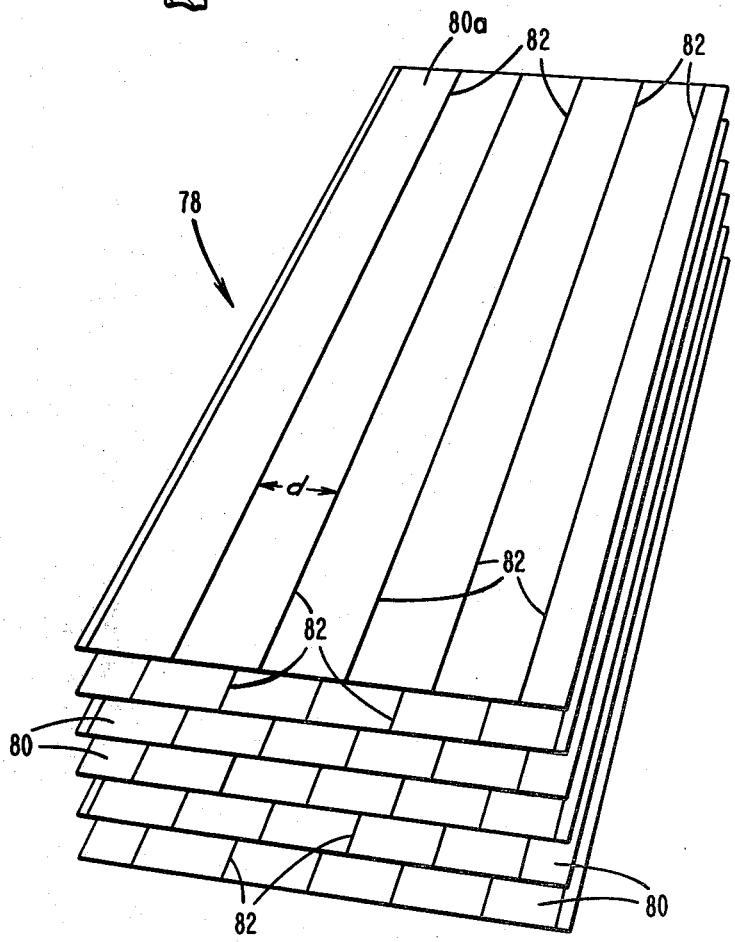
FIG. 10

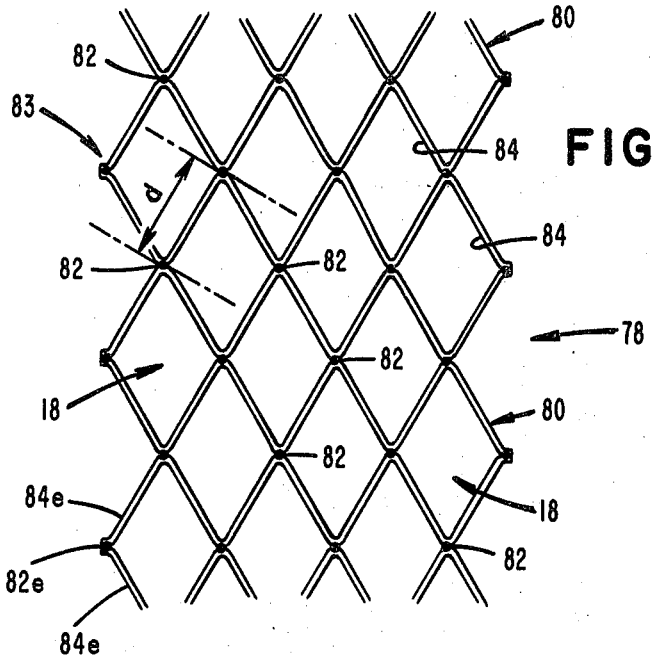
FIG. 11
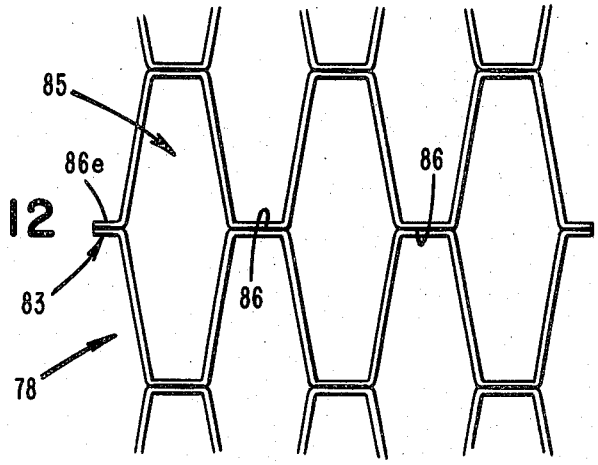
FIG. 12
FIG. 13
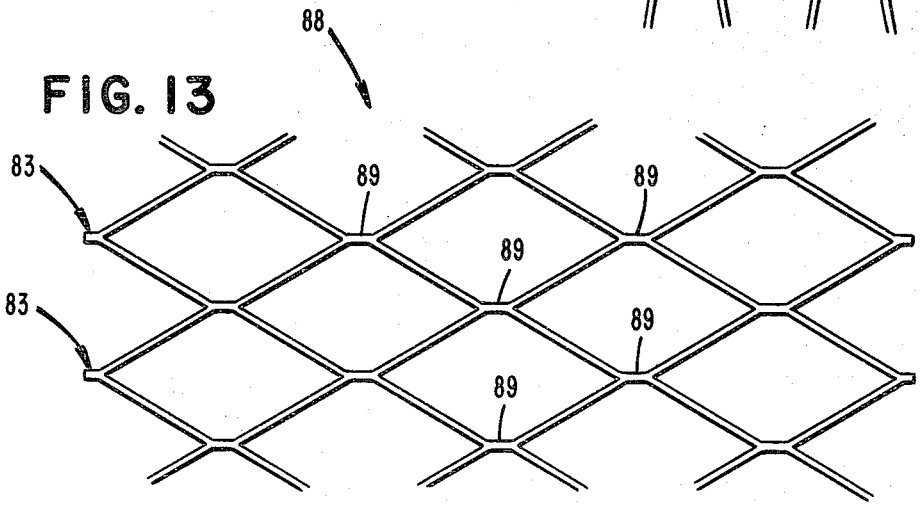

ENERGY CONSERVING INSULATIVE WINDOW SHADE

CROSS-REFERENCE TO RELATED APPLICATIONS

This application is a continuation-in-part of application Ser. No. 879,356, filed Feb. 21, 1978.

FIELD OF INVENTION

This invention relates generally to window coverings and, in particular, to heat-insulative and thermally efficient window coverings capable of reducing heat loss or gain through a window or similar "thermal opening".

BACKGROUND OF INVENTION

Windows, transparent walls, and similar "thermal openings" in buildings have long been known to be a major source of heat loss from a building during cold periods and of heat gain during warm periods. The heating and cooling of a building has thus been known to require greater amounts of energy than would be necessary in the absence of windows or other "thermal openings". To the end that windows and the like can be configured to reduce such heat gains and losses, double-layered glass and similar insulative structures have been utilized. Further, it has come to be known that window coverings, such as shades, blinds, and curtains, provide at least some reduction in heat loss and/or heat gain relative to an otherwise exposed window.

As an example of a window shade structure of increased thermal efficiency relative to the substantially planar, relatively poor insulative window shading structures long known in the art, Luboshez, in U.S. Pat. No. 2,874,612, discloses a window shade having sections angularly disposed relative to each other, alternate sections being coated on at least one side with a heat-reflective material. The Luboshez shade structure is only one example of prior attempts to reduce heat gain, there having been similar attempts to reduce heat loss from an environmental space. The trapping of air between an essentially permanent, non-drawable window covering and a window surface has also been previously described in the art for reduction of heat flow through a window, seals being previously provided between such coverings and the frame holding the glass pane portion of the window to complete a "dead air" space between the covering and the window.

Other patents of interest include British Pat. Nos. 11,493 and 756,270 and U.S. Pat. Nos. 1,827,218; 1,937,342; 1,942,989; 2,170,877; 2,477,582; 2,551,736; 3,055,419; 3,256,931; 3,294,151; 3,294,152; 3,443,860; 3,465,806; 3,887,739; 3,899,326; 3,946,789 and 4,019,554.

While some of the window shades or coverings which have heretofore been proposed are capable, to some degree, of reducing heat loss or heat gain through a thermal opening, they are not entirely satisfactory particularly in reducing heat loss or gain by "convection". It is a matter of common experience that in addition to heat loss or heat gain through the window pane, considerable heat is often lost or gained by convection through the sides of the window frames. This convective heat loss or gain can frequently represent a significant amount of the total heat or energy.

Accordingly, it is an object of this invention to provide a shade structure for reducing the total heat loss or heat gain through a thermal opening, such as a window.

It is another object of this invention to provide a shade structure of unique configuration and design comprising a plurality of contiguous channels having "dead air" spaces, and a sealing structure extending along the window frame uniquely cooperating with the specially configured shade structure to insure against heat loss or gain, including convective heat loss or heat gain through the window.

It is also an object of this invention to provide a shade made of a generally flexible and resilient material comprising a plurality of contiguous channels of a generally honeycomb configuration having a plurality of air-entrapping cells, designed to cooperate with the sealing structure to minimize heat loss or gain, including convective heat loss or heat gain through the window.

The foregoing and other objects of this invention will become apparent from the following detailed description of the invention taken in conjunction with the accompanying drawings.

SUMMARY OF THE INVENTION

Shade structures comprised of a multiplicity of contiguous air-entrapping channels or lumen, the invention provides window coverings having a "depth" formed by the air-entrapping channels, the channels forming a honeycomb appearance in axial cross section in a preferred embodiment. The respective ends of the channels are caused to be disposed adjacent to the frame of the window, seal structure disposed between the opposing surfaces of the frame and edges of the shade (and thus the ends of the channels) acting to entrap air within at least certain of the channels and primarily between the shade and the window, thereby to insulate an interior environmental space against heat loss or heat gain through the window. The channels of the shade are preferably formed by construction of the shade from a plurality of initially parallel layers of a relatively thin and flexible material, each layer being joined to adjacent layers along narrow spaced parallel lines, these lines of connection on opposite planar faces of each layer alternating in spaced relation to each other. The "honeycomb" structure thus formed provides a multiplicity of essentially parallel hollow channels within the shade, the channels being substantially equal in size. Effective "dead air" volumes thus formed within the channels act to provide insulative capability to the shade.

Sealing structure provided along vertical and/or horizontal edges of the honeycomb shade acts to impede convective air flow and thus reduce convective heat loss or heat gain through the window frame.

Sealing structures for the horizontal channel embodiment of the shade include vertical members extending from the plane of the vertical window frame surfaces and being received within vertically disposed grooves in the vertical edges of the shade body in order to complete formation of a trapped air space between the window and the shade. Edges of the shade defining the vertically disposed grooves act to seal the shade when in the "drawn" position due to contact between said edges and opposing surfaces of the vertical members. The vertical members also serve as guide rails or tracks for maintaining the shade in proper position when raising and lowering the shade.

In the vertical channel embodiment of the invention, at least one horizontal guide member disposed along the lowermost horizontal side of the window frame extends from said frame to be received within horizontal grooves formed in the lowermost horizontal edge of the shade body. Edges of the grooves act as described above to form a seal with opposing surfaces of the guide member. Similar sealing structure is preferably disposed along the uppermost horizontal side of the window frame.

BRIEF DESCRIPTION OF THE DRAWINGS

FIG. 4 is a perspective view of the assembled honeycomb shade of FIG. 2, but in a retracted or "open" conformation;

FIG. 5 is a plan view in section of the structure of FIG. 3 in a "closed" position, material edges defining the vertical slots within which the guide members respectively are received being shown contacting the guide members to facilitate sealing and the side edges of the shade body being shown to effectively contact the mounting plates;

FIG. 6 is a detail side elevational view in section of the structure of FIG. 2 shown in a drawn or "closed" conformation with the mounting plate being cut-away, material edges defining the vertical slot within which the guide member is received being seen to "neck down" or to extend into contact with opposing surfaces of the guide member to form an improved convective air seal along each vertical side of the shade body;

FIG. 7 is a detailed perspective view illustrating the edges of the vertical slots formed in the shade body and sealing structure associated with the draw bar;

FIG. 9*a* is an elevational view in section of a honeycomb shade mounted in a window and illustrating the location and operation of pull cords used to raise and lower the shade;

FIG. 9*b* is a detailed sectional view of a planar facing portion of the structure of FIG. 9*a;*

FIG. 10 is an idealized perspective illustrating the manufacture of the honeycomb shade body and particularly illustrating alternately disposed adhesive "lines" which are laid on sheets comprising the shade body;

FIGS. 11–13 are idealized elevational views in section illustrating various embodiments of the honeycomb structures useful for forming the shade body;

DETAILED DESCRIPTION OF THE PREFERRED EMBODIMENTS OF INVENTION

Figure 1:
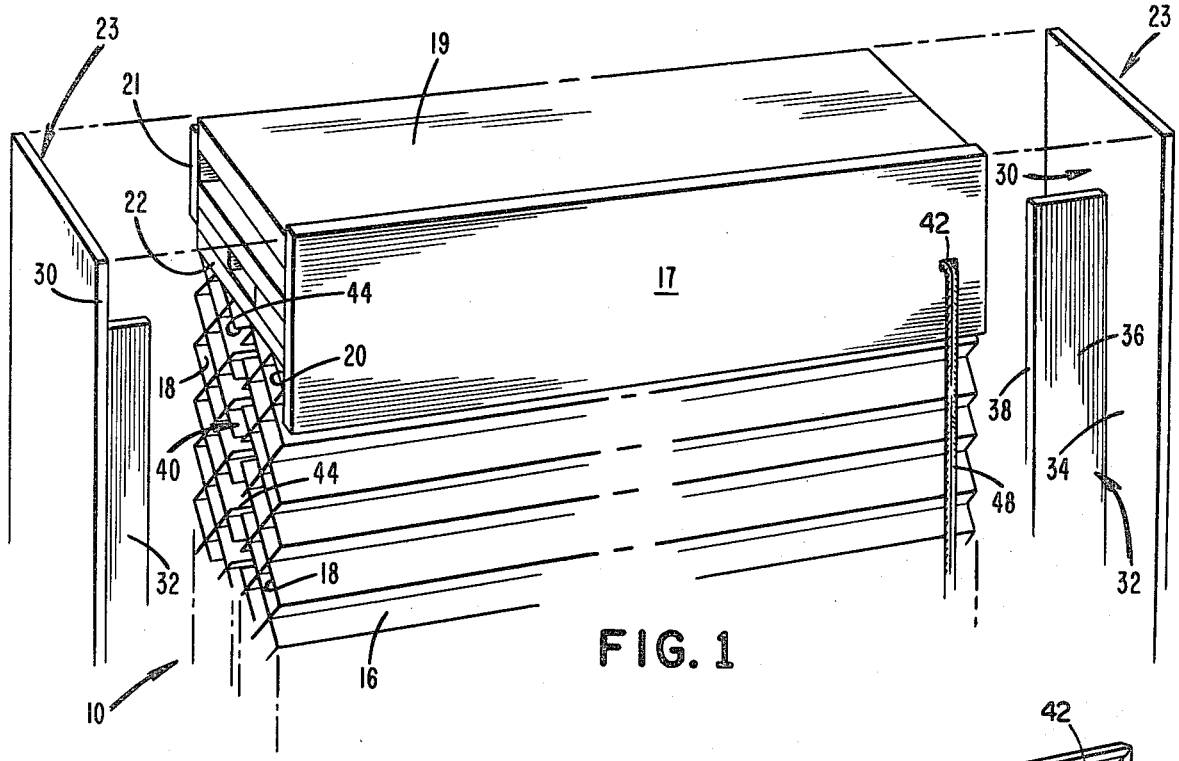
FIG. 1 is a detail assembly view of one embodiment of a honeycomb shade installation according to the invention in a drawn or "closed" conformation prior to installation in a window frame and having projecting guide members formed integrally with mounting plates which fit against vertical window frame surfaces, the guide members further serving to provide surfaces against which portions of a seal can be formed to prevent convective heat flow about vertical edges of the shade.
Figure 2:
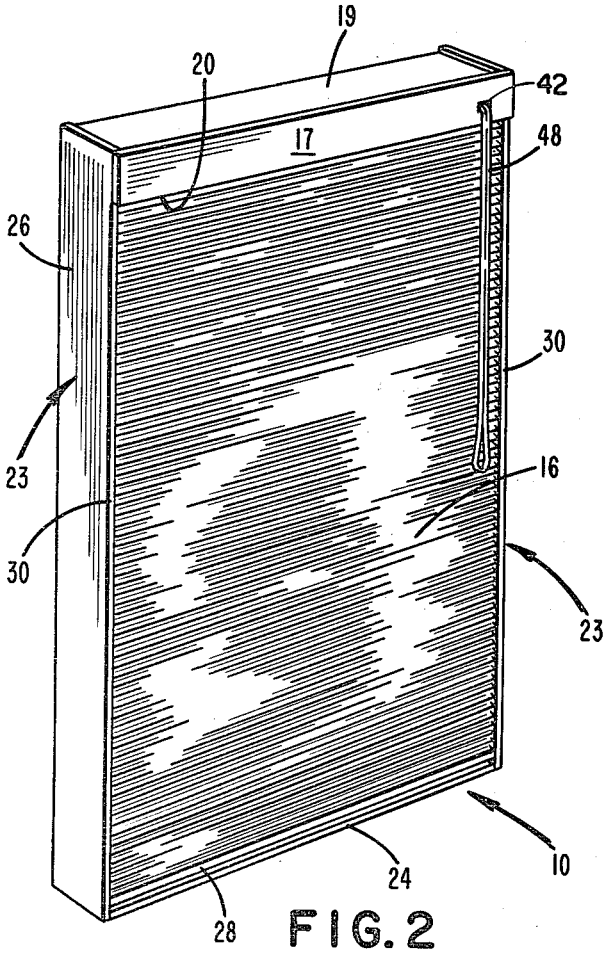
FIG. 2 is a perspective view of the assembled shade of FIG. 1 in the drawn or "closed" conformation.
Figure 3:
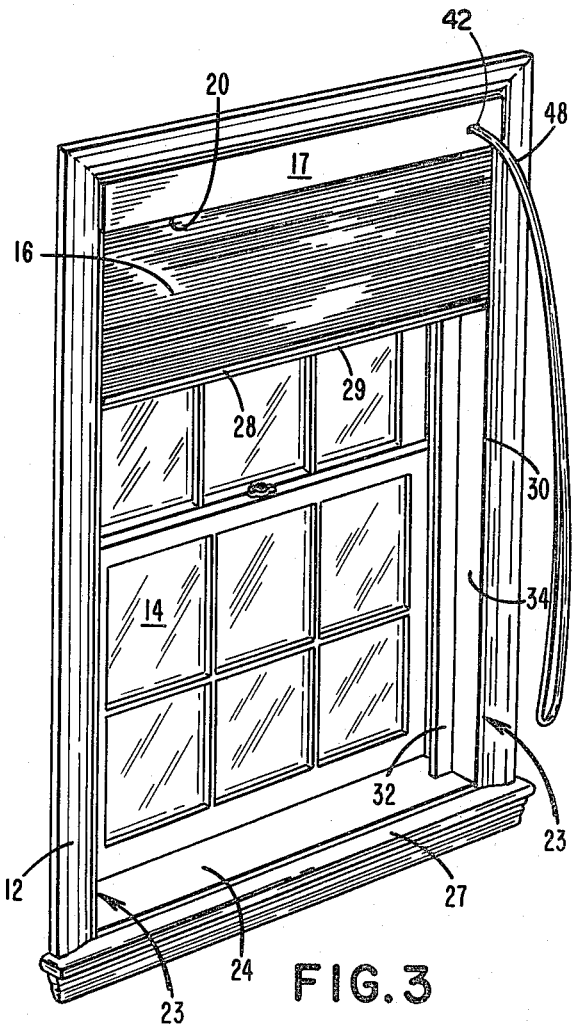
FIG. 3 is a perspective view of the shade shown in FIG. 2 mounted in a window frame, the shade being partially retracted.

The invention in its general sense provides a drawable shade comprising a shade body and associated structure cooperating with portions of the shade body to prevent convective heat flow through or about the periphery of the shade body. In effect, the associated structure acts in concert with the portions of the shade body to "seal" against convective heat flow. In principle, the "sealing" referred to herein is in essence equivalent to "impeding" convective air flow. The present shade structures also act to substantially reduce radiant and conductive heat flow through a window or "thermal opening" and thus act to reduce heat transfer by all of the possible heat transfer mechanisms, a capability not possessed by prior art drawable shade structures to the degree of efficiency exhibited by the present structures.

In a less general sense, the present invention contemplates a drawable shade capable of reducing convective heat loss as described above, and wherein the body of the shade is formed of a multiplicity of essentially parallel elongated channels which "surround and contain" air, and which effectively create "dead air" spaces, particularly insulative against both conductive and convective heat flow. The associated structure disposed about the "free " sides of the shade body which are not fixedly connected to associated mounting structure. For example, a vertically displaceable shade according to the invention is typically fixed to mounting structure along the uppermost horizontal side of the shade body and is effectively "sealed" along the "fixed" side by an essentially permanent connection therealong. The remaining "free" sides of the shade body must therefore be "sealed" against convective flow by the associated structure referred to above, this associated structure usually acting in concert with at least portions of the shade body itself. The associated structure may also provide other functions accessory to the operation of the shade. Typically, the associated structure which assists in sealing those sides of the shade body which lie in the direction of extension of the shade differs from the structure which seals the side of the shade body lying opposite the fixed side. The associated structure assisting and/or providing the described sealing function can take a variety of forms, as will be described in detail hereinafter.

Particular embodiments of the invention include the formation of a multi-channel shade body having a "honeycomb" structure as shown, for example, in FIGS. 10–14. In these embodiments, the channels are formed by thin sheet-like layers of material joined together along spaced parallel lines by an adhesive material, these adhesion lines being alternatingly disposed between adjacent layers of material on opposite sides thereof.

Referring now to the drawings, and particularly to FIGS. 1–5, one embodiment of the present shade assembly is seen at 10 for installation within a standard window frame 12 in which is mounted conventional glass panes 14 either permanently or for movement with a window in a conventional manner. The shade assembly comprises a shade body 16 having a multiplicity of regularly arranged contiguous cell-like channels 18 extending throughout said body 16, the longitudinal axes of the channels 18 extending horizontally through the shade body in essentially parallel manner. The channels 18 serve to entrap or to at least temporarily hold air therewithin to contribute to the insulation of the interior environmental space from heat flow across the window or other thermal opening. Dead air spaces are thus effectively formed within the channels 18. Preferred structural conformations of the channels 18 will be described hereinafter relative to FIGS. 10–14 inter alia.

The shade body 16 is drawable into a compact volume within storage compartment 20 when in the stored or "open" conformation as shown in FIG. 4. The shade body 16 can be drawn by means of a pull cord arrangement such as described hereinafter relative to FIGS. 9*a* and 9*b*. Alternately, the shade body 16 can be manually raised and lowered or can be displaced through the use of other conventional draw structure. As can be noted through a comparison of FIGS. 2 and 4, the shade body occupies in the stored or "open" conformation, a volume which is substantially reduced relative to the shade body volume of the drawn or "closed" conformation. Thus, the shade body 16 is compactly stowed within a relatively insignificant volume when not in use. The upper horizontal side of the shade body is permanently mounted to a lower face of an interior, rectangular plate member 22 in a conventional manner. The plate member 22 can conveniently form a portion of the storage compartment 20. The shade body 16 is thus effectively "sealed" against convective heat flow along its upper horizontal side.

As is shown particularly in FIGS. 1–5, the shade assembly 10 comprises the shade body 16 and the storage compartment 20 which is defined by header plate 17, upper plate 19 and rear plate 21, the plates 17, 19 and 21 forming the U-shaped storage compartment 20 within which the plate member 22 is disposed. The upper horizontal side of the shade body 16 could, of course, be mounted directly to the underside of the upper plate 19. The plates 17, 19 and 21 are formed of wood, plastic, metal or other suitable relatively rigid material and cooperate with T-shaped side frames 23 and bottom plate 24 to form a framework of the shade assembly 10 within which the shade body is raised and lowered. In practice, the framework formed of the plates 17, 19 and 21, the T-shaped side frames 23 and the bottom plate 24 can be sized to fit directly into the window frame 12 as is particularly seen in FIG. 3. The dimensions of the framework can be custom sized (along with custom sizing of the shade body 16) to fit a particular window or the entire shade assembly can be mass produced to fit windows of standard sizes. In either situation, the T-shaped side frames 23 are mounted flush against the vertical side wall surfaces 25 of the window frame 12. Outer surfaces 26 of the T-shaped side frames can be adhered to the wall surfaces 25 or otherwise mounted thereto in order to prevent air flow between the frames 23 and surfaces 25.

In a situation where the frames 23 are not directly attached to the plates 17, 19 and 21 and/or to the bottom plate 24, a contact adhesive and sealant or other adhesive material could be pre-coated onto the outer surfaces 26 of the T-shaped side frames 23. Mechanical fasteners could alternatively be employed to mount the side frames 23 to the window frame 12. The bottom plate 24 can be omitted entirely from the shade assembly 10, particularly in those situations where the T-shaped side frames 23 and the plates 17, 19 and 21 are to be mounted separately in the window frame 12. In such situations, lower horizontal surface 27 of the window frame 12 can cooperate with draw bar 28 to form a lower horizontal seal, which seal would, in the case where the bottom plate 24 is included in the total framework, be provided by cooperation between the draw bar 28 and the bottom plate 24.

When the shade assembly 10 is "drawn", the shade body 16 can be "sealed" along the lower horizontal side thereof by contact with the bottom plate 24 or with the surface 27 of the window frame 12 in the event that no bottom plate 24 is provided. When the surface 27 (on the upper surface of the bottom plate 24) is essentially flat and thus allows even contact with the lower horizontal surface of the draw bar 28, further sealing structure is not required along the lower horizontal side of the shade body 16. However, as will be described in more detail hereinafter, additional sealing structure is preferably provided in order to create a more effective seal. As a practical matter, window frames are not sufficiently "plumb" to allow mere contact between the vertical and lower horizontal sides of the shade body to provide sealing of the degree deemed desirable. Some reduction in heat transfer would, of course, be produced by such a structure. The draw bar 28 is simply attached to the lower horizontal side of the shade body 16 as shown in FIGS. 2, 3, 4 and 7 with similar embodiments also shown in FIGS. 8 and 9.

The draw bar 28 adds weight to the lowermost side of the shade body 16 and thus assists in drawing the shade. The disposition of a flat, substantially planar surface along the lowermost horizontal surface of the draw bar 28 facilitates a sealing contact with either the surface 27 or with the bottom plate 24, thereby to form at least a minimal convective "seal" along the lower horizontal side of the shade body 16. Although use of the draw bar 28 is preferred, the bar 28 can be omitted and the lower horizontal edge of the shade body can "seal" against the surface 27 or the bottom plate 24. In either situation, the lower horizontal side of the shade body 16 or the horizontal undersurface of the draw bar 28 can be fitted with additional structure to facilitate formation of the seal between the shade body 16 and the surface 27 on the bottom plate 24.

As is seen in FIGS. 4 and 7, one or more elastometric "wiper" blades 29 are disposed on the lower horizontal surface of the draw bar 28 and extend downwardly. When the shade body 16 is fully lowered, the blades 29 bias resiliently against the surface 27 on the bottom plate 24 to facilitate sealing therebetween. The blades 29 are preferably arcuate in conformation and can extend laterally at distal ends thereof to increase the compressive sealing effect.

In the particular embodiment of FIGS. 1–7 and also in certain other embodiments shown and described herein, convective sealing along the vertical sides of shade body 16 can be accomplished through the use of structure which can also act to guide the shade body in a desired path when the shade is raised or lowered. As has been previously noted, the T-shaped side frames 23 are attached to the window frame 12 along vertical frame surfaces and essentially extend the full vertical height of the window frame. The leg portion of each T-shaped side frame 23 extends inwardly from side plate portion 30 and forms a slat-like member generally rectangular. This leg portion of each T-shaped side frame 23 assists in forming a convective seal along the respective vertical sides of the shade body 16 and is thus referred to as sealing slat 32.

The sealing slats 32 can be formed integrally with the corresponding side plate portion 30 of each T-shaped side frame 23. Alternatively, sealing slats 32 alone can be mounted directly to respective inner vertical walls of the window frame 12 and thus extend inwardly of the window frame 12. In this and in certain other embodiments of the invention, major portions of the sealing slats 32 are received within elongated vertical slots 40 formed in respective vertical sides of the shade body 16. The slots 40 extend the full vertical sides of the shade body 16. The slots 40 extend the full vertical height of the shade body 16 regardless of whether the shade body is fully retracted or fully drawn out to cover the window opening. In the fully retracted position, the slots 40 will have a "length" which is much less than the "length" of the slots when the shade is fully drawn, just as the shade body 16 is much reduced in the vertical dimension when retracted. The slots 40 are essentially cut from the vertical sides of the shade body 16 such as by stamping when the material from which the shade body 16 is formed is in its most compact configuration, the innermost adjoining central channels 18 have substantially U-shaped cuts thus formed therein, a shade body typically having portions of the U-shaped cut formed in adjoining channels.

Although not shown, the faces 34 and 36 of the sealing slats 32 are spaced from opposing side edges 44 and central edges 46 of the slots 40 when the shade body 16 is "open" or fully retracted. In particular, a small spacing between the side edges 44 of the slots 40 and the side faces 34 of the sealing slats 32 is preferred when the shade body 16 is fully retracted in order for the shade body to be capable of a more free movement along the sealing slats 32 as the shade is drawn out to the "closed" position. While the shade body 16 could be drawn from the fully retracted position of FIG. 4 even if contact between the side edges 44 and the side faces 36 occurred when in this position, substantial friction results from such contact due to a "necking down" of the edges 44 as the shade body is fully extended. This "necking down" and the particular advantages obtained from this characteristic of the shade body 16 when formed of the honeycomb structure according to the invention will be hereinafter described in connection with FIGS. 5 and 6.

The vertical sides of the shade body 16 and opposing inner vertical surfaces 34 of the side frames 23 (or of the window frame 12) are essentially flush and are in slightly "brushing" contact as the shade body is raised and lowered. This contiguous fit provides an impediment or "seal" against convective heat flow along the vertical sides of the shade body, and thus can constitute a "sealing" structure formed by the vertical sides of the shade body itself when allowed to contact the vertical surfaces 34 of the side frames 23. This brushing contact also acts to reduce and restrict air flow through the channels 18, thereby to effectively "seal" the interior of the channels from ambient and thus to create "dead air" volumes within said channels. This "sealing" structure thus acts to reduce air movement between that air space lying between the glass panes 14 and the shade body 16 and the environmental space. The "sealing" structure also acts to reduce air movement through the channels 18. In effect, this "sealing" structure acts as a "seal" against convective flow between the environmental space, that is, a room in a dwelling or the like, and the insulating air space effectively trapped between the panes 14 and the shade body 16.

The sealing slats 32 also serve a "guiding" function by providing "track" structure along which the shade body 16 moves when the shade assembly 10 is raised and lowered. However, the shade body 16 is effectively "guided" or maintained in a proper path by means of pull cords 48 which can extend through inner portions of the slots 40 adjacent the distal faces 38 of the sealing slats 32, the pull cords 48 connecting to the draw bar 28 at one end, extending through the storage compartment 20 and exiting the header plate 17 through aperture 42 formed therein. The pull cords 48 act in concert with conventional draw structure to raise and lower the shade body 16.

In the embodiment of FIGS. 1–4, for example, the sealing slats 32 are received within the slots 40 and slots 49 disposed in either end of the draw bar 28, and help to maintain the shade body 16 in a desired position not only when the shade body is being raised and lowered, but also when the shade body is in the fully retracted or fully drawn configuration, and even when in between those positions. As seen from a comparison of FIGS. 2 and 4, the sealing slats 32 are fully covered when the shade body 16 is fully lowered and are almost fully uncovered when the shade body is fully raised.

While the sealing slats 32 serve a significant function as tracks to maintain the shade body 16 on a desired path and to prevent a "bowing out" of the shade body either when displaced or when stationary, the sealing slats 32 in a preferred embodiment of the invention primarily act in concert with the side edges 44 of slots 40 to produce a very effective convective "seal" along the vertical sides of the shade body. As noted above, the contact between the vertical sides of the shade body 16, that is, the ends of the channels 18, and the vertical surfaces 34, provide a sealing function. As it was previously mentioned, the side edges 44 of the slots 40 are inwardly displaced (relative to the sealing slats 32) as the shade body 16 is lowered into the closed or drawn position. This inward displacement or "necking down" occurs as a result of the vertical elongation of the channels 18 as the shade body 16 is extended and occurs when the shade body is formed of a honeycomb-like structure as is described for example in FIGS. 10–14. Even though the edges 44 are spaced from the opposing side faces 36 of the sealing slats 32 when in the fully retracted position of the shade body 16, as seen in FIG. 4, the edges 44 move toward the faces 36 and eventually contact said faces 36 as the shade body nears full extension, the relative contacting positions of the edges 44 and the faces 36 being seen in FIGS. 5 and 6.

Since the sheet-like materials of which the shade is made is flexible and resilient, the free edges 44 flex so that portions thereof will lie relatively flat against the side face 36 of the slat 32 to insure effective convective sealing.

The dimensions of the intial spacing between the edges 44 and the faces 36 when the shade body is fully retracted determine the degree of elongation of the shade body necessary to first result in contact between the edges 44 and the faces 36. This initial spacing can be dimensioned to allow contact between the edges 44 and the faces 36 well prior to full lowering of the shade body 16, thereby resulting in a more forceful contact between the edges 44 and the faces 36 when the shade body 16 is then further lowered to the extension necessary to fully draw or "close" the shade body over the window. The convective seal thus formed is particularly effective as is evidenced by the comparative experimental data presented hereinafter.

Figure 8A:
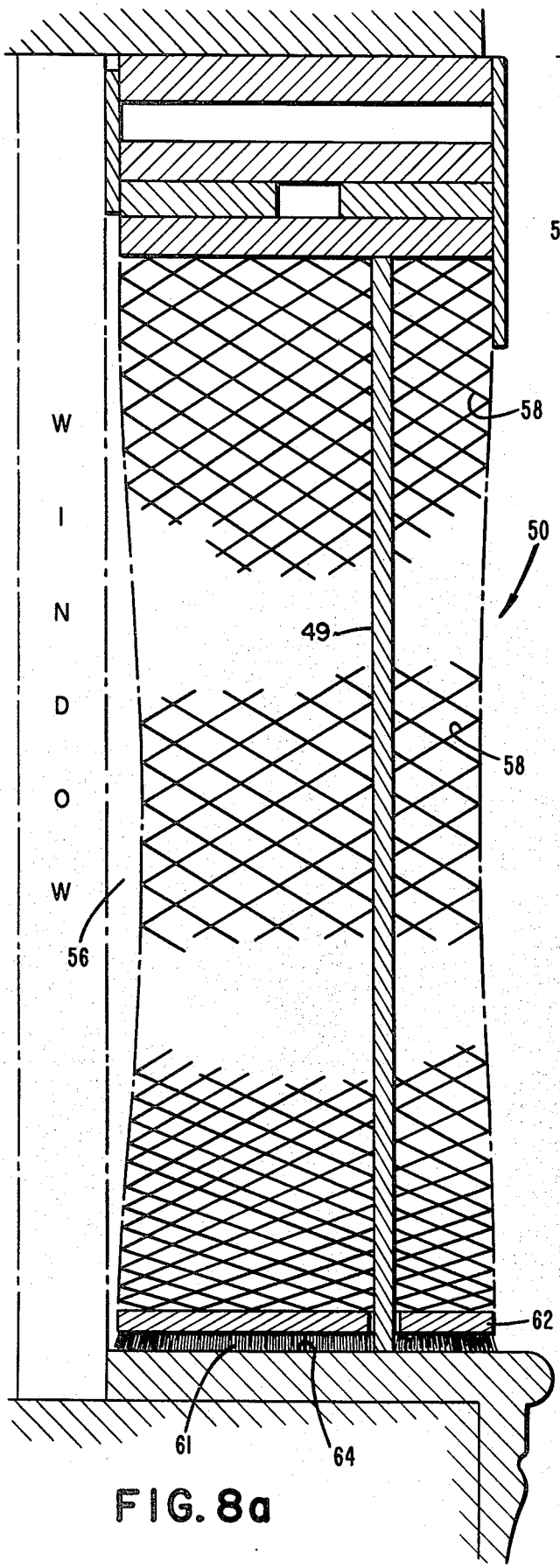
FIGS. 8*a* and 8*b* are elevational views in partial section of a honeycomb shade having guide members disposed nearer the "room" side of the shade, the guide members also acting as in other embodiments to provide surfaces against which convective sealing is accomplished through contact with vertical slots formed in the shade body and within which slots the guide members are respectively received.
Figure 8B:
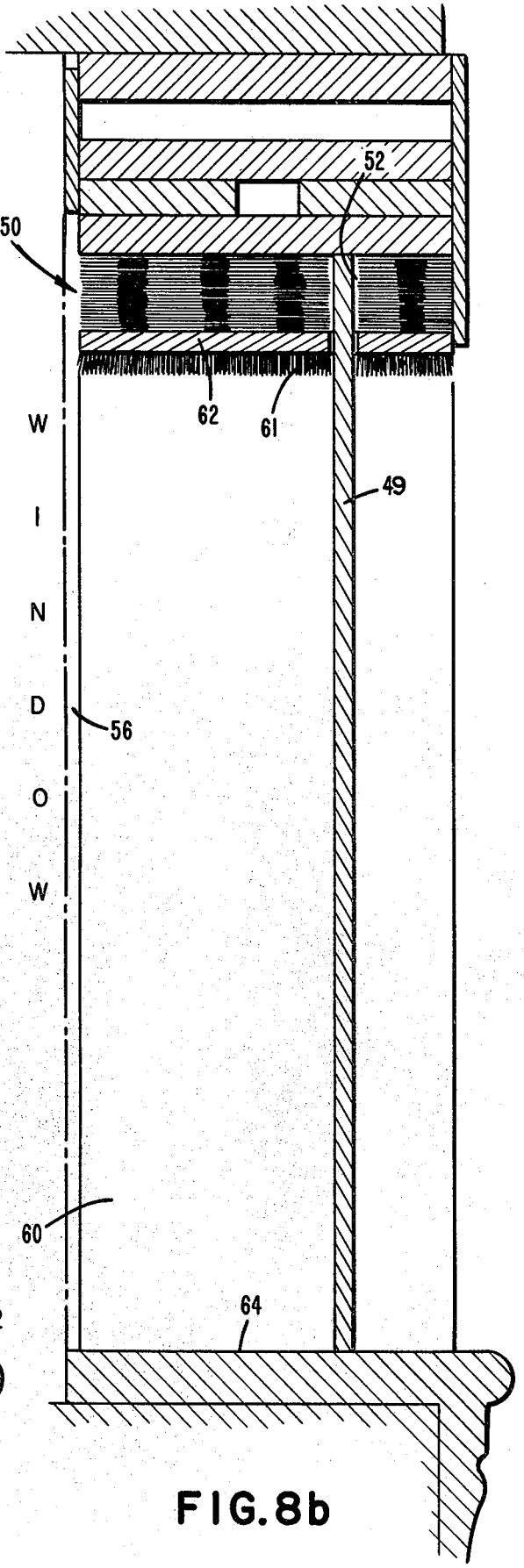

While the embodiments of FIGS. 1–7 have been described with the sealing slats 32 effectively disposed in positions centered relative to the vertical sides of the shade body 16, it can be seen in FIGS. 8*a* and 8*b* that sealing slats 49 essentially equivalent to the sealing slats 32 can be disposed and are preferably disposed nearer the "room" side of the shade body 50. That is, the sealing slats 49 and slots 52 formed in vertical sides of the shade body 50 are located as great a distance from glass pane 56 as is possible given the depth-wise number of channels 58 which form the shade body 50. When the shade body 50 is more than three channels deep, that is, three channels per horizontal layer of channels 58, then the slots 52 can be more effectively offset on the vertical sides of the shade body 50 toward the "room" side of the shade body. The sealing slats 49 can be attached to vertical frame surfaces of the window frame 60 nearer the room and further away from the glass pane 56 or to T-shaped side frames which would correspond to the frames 23 of FIGS. 1–7. In actual testing, a 5-channel shade body having a nominal depth of 5 inches was fitted with centered sealing slats such as the sealing slats 32 of FIGS. 1–7. The distance between the convective seal thus formed by the sealing slats 32 and the glass pane was $2\frac{1}{2}$ inches, the convective sealing function including the contribution of the "necked down" edges 44 as described above. The insulating effectiveness of this "centered seal" structure was measured in terms of the window heat loss U in BTU/ft$^2$/hr/°F. and was determined to have a value of 0.34. An identical shade body except configured according to FIGS. 8*a* and 8*b* with the convective seal located $3\frac{1}{2}$ inches from the glass pane, that is, nearer the room side of the shade body, yielded a window heat loss U of 0.29, the difference being attributable to the location of the sealing slats 49 nearer the room side of the shade body. As alluded to above, these "offset" sealing slats 49 and "offset" slots 52 are preferably configured to utilize the "necking down" effect of side edges of the slots 52 as fully described relative to the embodiment of FIGS. 1–7. The increased insulative function cntributed by the offset location of the convective seal thus formed is believed due to the isolation of a greater number of channels 58 from the room ambient. The shade structure is thus believed to be subject to less convective loss from the room through the channels 58.

In the same series of tests from which the data given above was taken, a shade body identical to the respective 5-channel shade bodies 16 and 50 but without the additional sealing function provided either by the sealing slats 32 or 49 had a window heat loss U of 0.60 BTU/ft$^2$/hr/F. In this test, the convective sealing function along the vertical sides of the shade body was provided only by contact between the ends of the channels and the vertical frame surfaces of the window frame. While this insulative value is excellent compared to prior drawable shade structures, the increased insulative capability imparted to the present shade structures by the sealing slats 32 and 49 in concert with the edges 44 of the slots 40 and the edges of the slots 52 is readily apparent.

FIGS. 8*a* and 8*b* also illustrate the use of a fabric-like pile or "fleece" material 61 to facilitate formation of a convective seal between draw bar 62 and lower horizontal window frame surfaces 64. The material 61 contacts the surface 64 on lowering of the shade body 50 and effects a seal between the draw bar 62 and the surface 64.

FIGS. 8*a* and 8*b* further illustrate the fact that the edges of the slots 52 are displaced inwardly toward sealing slats 49 as the shade body 50 is lowered from the fully "open" position of FIG. 8*b* to the fully "drawn" position of FIG. 8*a*. As can be seen in FIG. 8*b*, the edges of the slots 52 are spaced from the sealing slat 49 when the shade body 50 is compressed. When the shade body 50 is lowered, the edges of the slots 52 begin to move inwardly toward the opposing surfaces of each of the sealing slats 49 to "neck down" into contact therewith as described relative to the embodiment of FIGS. 1–7. Actually, the entire width of the shade body 50 compresses inwardly at medial portions of the shade body as can be seen in FIG. 8*a*. In the position shown in FIG. 8*b*, the width or "thickness" of the shade body 50 is essentially constant. In FIG. 8*a*, the thickness of the shade body 50 is essentially equal only at extreme upper and lower ends of the shade body, medial portions having thicknesses which taper from each end of the shade body to a minimum thickness medially of the shade body 50. The tapering of the entire thicknesses of the shade body 50 results from the same forces which cause the slots 52 to compress and thus causes the edges of the slots 52 to "neck down" and seal on opposing surfaces of the sealing slats 49. This characteristic also occurs with the vertical channel embodiments shown in FIGS. 16–21.

As noted above, the vertical shade embodiments of the invention can be raised and lowered through the use of a pull cord arrangement such as is shown in FIGS. 9*a* and 9*b*. As seen in these figures, a pull cord 66 such as is commonly used for "venetian" blinds and other window coverings is employed with a conventional stop mechanism (not shown). The pull cord 66 is seen to conveniently form a loop externally of the shade structure, the two lengths of the cord 66 extending into shade housing 68 through cord aperture 70. The two lengths of the cord 66 (only one visible and shown internally of the housing 68 and the shade body) extend within the shade housing 68 toward respective elongated vertical channels 72 through which said cord portions respectively extend downwardly to connect with draw bar 74. The draw bar 74 can thus be drawn upwardly by pulling on the cord 66, the weight of the draw bar further assisting in lowering the shade. The draw bar 74 can conveniently be provided along the undersurface thereof with a material to facilitate sealing against horizontal surfaces of the window frame within which the shade assembly is mounted. However, due to the weight of the draw bar 74 and the nature of the honeycomb material, a convective seal of a more limited effectiveness can be formed by mere contact between the lower surface of the draw bar 74 and lower horizontal window frame surfaces 76. In the embodiment of FIGS. 9*a* and 9*b*, it is to be noted that the pull cords 66 do not extend through slots 75 in vertical sides of the shade body within which sealing slats 77 are received. It is again noted that the pull cords 66 serve a guiding function to maintain the shade body in a desired path.

The preferred structure of a shade body such as the shade body 16 takes the form of a "honeycomb" as shown generally at 78 in FIGS. 10–14. FIG. 10 particularly illustrates the manner in which the honeycomb structure 78 is formed. The honeycomb 78 is seen to be formed from a plurality of thin sheets 80 which are generally rectangular and of the same dimensions. The sheets 80 are preferably formed of a flexible, resilient material such as nonwoven textiles, treated paper or plastic films which resist actinic degradation. Cellulosic and polyester fibrous materials and glass fibers are suitable. Acrylic, PVC, PVA and the like binder materials which are not moisture sensitive are also preferred. The fibers can comprise acrylic, polyester, and even wood fibers, and a combination of a hydrophobic binder and fiber acting to produce a sheet 80 which will withstand repeated wetting, long exposure to sunlight and other elements without significant degradation or loss of strength and structural integrity. Nonwoven material of polyester fibers constitutes the most preferred material.

The use of polyester fibers in the nonwoven sheets 80 allows heat setting so that a return to an original conformation would be enhanced, thereby facilitating retraction into a compact volume and promoting a neat appearance, even after extensive periods of use. Thicknesses of these materials which are the equivalent of 12–14 pound paper tissue are adequate, the sheets typically weighing between 1 to 2 ounces per square yard. Although more expensive, woven and knitted textiles could also be used as well as a variety of paper materials.

The sheets 80 in FIG. 10 are layered in superposed relationship to form a "blanket" which can be cut and trimmed to a desired size as necessary. The sheets 80 are mutually joined together along adhesion lines 82 which, in the shade body having horizontally disposed channels 18, extend parallel to the width-wise dimension of the shade assembly 10, that is, parallel to the plane in which the shade body lies. The adhesion lines 82 simply comprise relatively narrow parallel lines or an adhesive material which are laid out on upper (or lower) surfaces of each of the sheets 80. The uppermost sheet 80*a* need not have any of the adhesion lines. As shown in FIG. 10 as well as in FIGS. 11–14, the pattern of the straight parallel adhesion lines 82 on any given sheet 80 is offset by one-half of the distance d between any two adjacent lines 82 formed on one of the sheets 80. Any given sheet 80 is thus bonded to adjacent sheets 80 along lines which alternate in an interdigitating fashion. In other words, a bond formed along one of the adhesion lines 82 to the adjacent sheet 80 disposed on a "lower" side of the given sheet 80 is disposed halfway between two bonds formed along two adjacent adhesion lines 82 disposed on the "upper" side of the given sheet 80. Since the distance between two adjacent lines 82 is taken to be d, then the bonds along the adhesion lines 82 on opposite sides of any given sheet 80 are offset in registry by 0.5 d. Each sheet 80 is thus joined or bonded to adjacent sheets 80 along the adhesion lines 82 with the lines 82 on opposite planar faces of each sheet 80 alternating in spaced relation to each other. The "honeycomb" structure 78 thus formed defines contiguous cell-like channels 18 which, when seen in cross section such as in FIGS. 11–14, resemble a multi-sided honeycomb. As indicated previously, the honeycomb channels 18 extend either horizontally or vertically through the body of the shade to entrap or at least temporarily hold air therewithin to insulate an environmental space from heat flow across a window or other "thermal opening".

The cross sections of the channels 18 vary according to the distance d between two adjacent adhesion lines 82 disposed on a given surface of one of the sheets 80. This distance d is preferably constant throughout a given shade body. The channels 18 are thus seen to be preferably comprised of thin sheet-like layers of material joined together along spaced parallel adhesion lines 82 by an adhesive material, the adhesion lines 82 being alternatingly disposed between adjacent layers of material on opposite sides thereof in an assembled configuration.

The outer ends of the sheets 80 are joined by edge adhesion lines 82*e* to form parallel and outwardly directed projections of the shade body. These projections prevent the outer walls of the honeycomb from folding inwardly (toward each other) when the shade is contracted. This particular structure and configuration of the honeycomb and the adhesion lines along the outer edges have advantages which are referred to throughout this description.

The adhesion lines 82 can be applied to both surfaces of a given sheet 80. In such a situation, the adjacent sheets 80 on both sides of the given sheet 80 need not have lines 82 applied thereto since the adhesive material applied to the given sheet 80 will bond each of said sheets to the adjacent sheet. In other words, only every other sheet 80 in the interior of the honeycomb 78 need have adhesion lines 82 applied thereto if said lines are applied to both surfaces of every other sheet.

Regardless of the method employed to fabricate the honeycomb 78, the structure of the multi-sided channels 18 prevent walls 84 of the channels from collapsing when in the extended configuration and thus touching each other, the insulating efficiency of the shade assembly being greatly reduced in the event of collapse of and resulting contact between the walls 84 of the channels 18. Although the walls 84 of the channels 18 do not contact each other when the shade body is extended, the channels 18 readily collapse when the shade body is retracted to allow the shade assembly 10 to occupy a substantially reduced volume when in the "stored" configuration as shown herein. Thus, the collapsible honeycomb structure 78 allows fabrication of a shade body comprised of a plurality of channels 18 which are closed when the shade assembly is in a retracted position and which are open and self-supporting when the shade body is drawn over a window or the like. In the closed or retracted position, the shade body occupies only a small space. In the drawn conformation, the shade body occupies a large volume and provides an unexpectedly high degree of insulation.

FIGS. 11–14*d*, illustrate certain specific configurations of the channels 18. In these figures, the cross-sectional shapes of the channels 18 can vary from regular hexagons to squares, FIG. 12 particularly illustrating hexagonal channels 85 formed by a laying out of relatively wide adhesion lines 86. Those channels 18 which have essentially equal wall dimensions (diamond-shaped or square in cross-sectional conformation) are so formed by the relatively narrow adhesion lines 82 as seen particularly in FIG. 11. The cross-sectional area of the channels 18 are thus seen to vary according to the width of the adhesion lines 82 or 86.

A typical value for the distance d is one inch, a shade body 16 so formed and being three channels 18 "deep" (such as is seen in FIG. 11) having a U of 0.31 BTU/F./hr/ft$^2$ with sealing as described as above relative to FIGS. 1–7. A 5-channel shade body has a typical U of 0.24 BTU/F./hr/ft$^2$. A 3-channel shade body such as is seen in FIG. 11 requires the laying down of 8 adhesion lines 82 in order to form the three-deep channel structure. It should be noted that the thickness of the sheets 80 are exaggerated in FIGS. 11–12 in order that the separate sheets 80 can be distinguished from each other and also to allow the adhesive material to be distinguishable as essentially comprising the adhesion lines 82 and 86.

In FIG. 13, a honeycomb structure 88 is formed integrally such as by extrusion through a die. The integral nature of the material 88 eliminates the adhesion lines referred to above. However, the material 88 maintains the capabilities of the material 78 of FIGS. 11–12 since integral joints 89 function similarly to the adhered sheets 80.

As is apparent from the foregoing description, each of the thin sheets 80 lie in or about both sides of planes which are respectively substantially horizontal, that is, the planes in which the sheets 80 lie are perpendicular to the vertical glass panes 14 when "closed". When a shade body such as the shade body 16 is fully drawn, the sheets 80 lie "about" the same horizontal plane, no portion of the sheet 80 being folded to an angle greater than or even equal to 90 and, as a practical matter, no more than approximately 75. Since the shade body will undergo a large number of "fold cycles" within its useful lifetime, it is of great importance that the sheets 80 need not be folded to a degree which would form a "crease", that is, to a degree greater than or equal to 90. The sheets 80 thus avoid material failure due to repeated folding, such failure being increased by the effects of exposure to sunlight, moisture and the like.

The preferred choice of the honeycomb structure 78 for formation of a shade body according to the invention particularly results in a structure wherein the material forming the shade does not undergo sharp folding, the resulting reduction in material fatigue being one unobvious advantage of these particular embodiments of the invention.

A further advantage of the use of the honeycomb structure 78 according to the invention also results from the lack of need for the sheets 80 to fold severely about the adhesion lines 82 or 86. Since the angle of the fold about said lines 82 (or 86) is less than 90, the walls 84 of the channels 18 cannot "bow" outwardly and prevent the shade body from being retracted properly. This structural characteristic also causes the surfaces of the shade body which are exposed to view to retain a neat and decorative appearance. Due to the use of the honeycomb structure 78, no need exists for external guides or supporting structure to insure proper expansion and contraction of the shade body without danger of fold-over of the channels 18. Since the honeycomb 78 is fabricated by applying the adhesion lines 82 to the surface of each sheet 80 upon which the next sheet 80 will be laid and thus bonded on contacting the adhesive material forming said adhesion lines, the sheets 80 are not even folded during manufacture.

As is also shown in FIG. 11, edge adhesion lines 82*e* further impart a stability to the shade body which prevents folding of the material forming the sheets 80. The edge adhesion lines 82*e* cause the shade body 16 to have entirely different raising and lowering characteristics than would be the case if, for example, outermost walls of the channels 18 were formed of a single, continuous length of material. In particular, the edge adhesion lines 82*e* prevent undue folding of the sheets 80 by not allowing the weight of the shade body 16 to pull the channels 18 into a cross-sectional shape which would resemble a thin, vertically elongated "oval" or generally rectangular shape. From a relative standpoint, the outermost channels 18 on both sides of the present shade body have two outermost walls 84*e* which are bonded together along the edge adhesion lines 82*e*, thereby eliminating the strength degradation which would occur on repeated folding and flexing about angles equal to or greater than 90 and also eliminates the degradation which occurs when a repeatedly stretched material is exposed to sunlight.

The edge adhesion lines 82*e* of FIG. 11 and 86*e* of FIG. 12 essentially couple together short substantially horizontally disposed opposed material edges from adjacent sheets 80, these edges comprising a joint 82 which also comprises the respective edge adhesion lines 82*e* or 86*e*. In FIG. 13, the joint 83 is essentially integral. These joints 83, in concert and due effectively to the edge adhesion lines 82*e* and 86*e* in the respective embodiments of FIGS. 11 and 12, forces the outer walls of the channels to constantly extend outwardly and to not be folded "back" into the shade body on raising or lowering of the shade body. Although the joint 83 of FIG. 13 is not provided per se with an edge adhesion line, the integral joint 83 serves this same purpose and prevents the outer walls from "going flat".

The honeycomb structure has other particular advantages. In particular, the honeycomb configuration imparts structural rigidity to the shade body which further improves certain other capabilities of the shade structures. This rigidity assists in maintaining the channels in an "open" conformation, i.e., preventing the walls of the channels from collapsing and thus losing insulative ability. Further, the rigidity of the total shade body structure causes the vertical sides of the shade body to remain in contact with the convective air seals, thereby further preventing the possible loss of insulating capability.

Figure 14A:
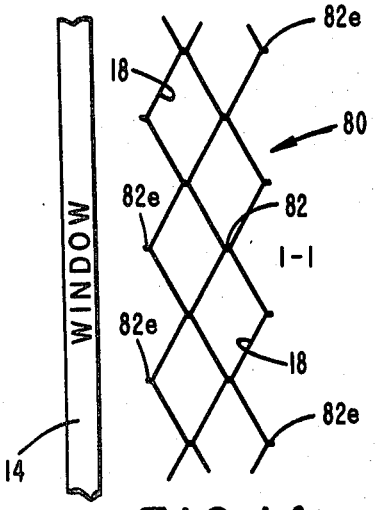
FIGS. 14*a* through 14*e* are diagrammatical sketches which illustrate varying thicknesses of the shade body and the effect of varying thickness on "R" value.
Figure 14B:
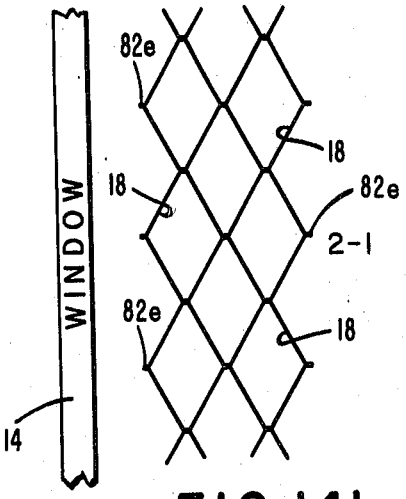
Figure 14C:
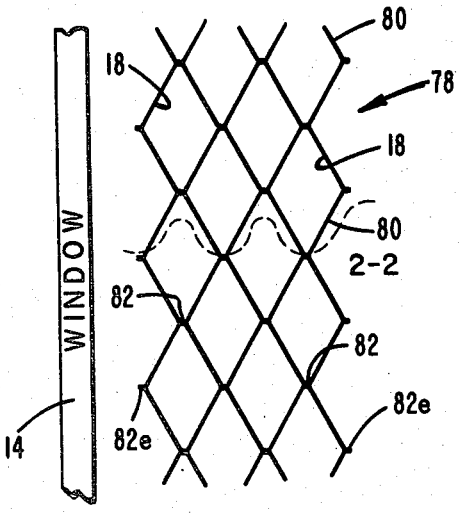
Figure 14D:
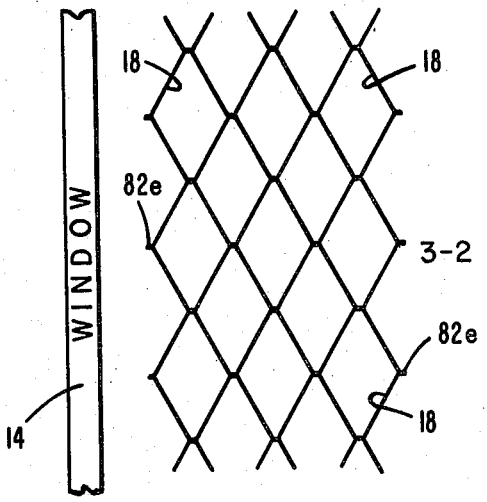
Figure 14E:
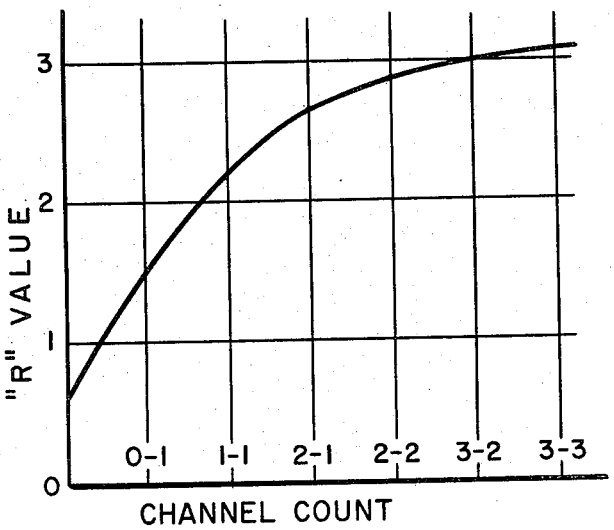

A comparison of FIGS. 14*a* through 14*e* exemplifies the differing configurations of the channels 18 which can be formed. In FIGS. 14–14*d*, the conformations of shade bodies have a varying number of channels 18 according to the "length " of the sheets 80 and the number of adhesion lines 82 formed on the sheets. In FIG. 14*a*, a 1—1 channel structure is shown, the numerical designation indicating that one channel is counted across the shade body regardless of which adhesion line 82 is chosen to begin the counting. In this embodiment of the honeycomb structure, four adhesion lines 82 would be formed on a given sheet 80, certain of these lines 82 also being edge adhesion lines 82*e*. The honeycomb structure of FIG. 14*a* is thus seen to be the least "thick" embodiment of the honeycomb structures and, as seen in FIG. 14*e*, the least insulative.

FIG. 14*b* illustrates a 2–1 channel embodiment, there being two channels 18 counted when beginning at each edge adhesion line 82*e* and one channel 18 in the "layer" of channels between each of the "two channel" layers. Similarly, FIGS. 41*c* and 14*d* illustrate 2—2 channel and 3–2 channel embodiments of the present honeycomb material. It can readily be seen that 3–3, 4–3 and other embodiments can be formed as desired. Further considering FIG. 14*e*, the "R" values associated with various channel counts (with all other factors being equal) are seen to vary according to the curve shown. In essence, the greater the number of channels, the higher the "R" value and the greater the insulative capability of the shade body so formed. It must be noted, however, that increasing the channel count beyond 3—3 results in a correspondingly lower increase in insulative capability.

Referring for illustration to FIG. 14*c*, the honeycomb structure 78 is seen to exhibit a "primary material direction" for each sheet 80 as indicated by the dashed line. The material is then seen to be deformed into relatively gentle undulations during a "work cycle" involving expansion and compression of the channels 18. Thus, the material is readily seen to avoid substantial flexural stress which could lead to failure of the material at the bonds between adjacent sheets 80, that is, at the adhesion lines 82.

Figure 17:
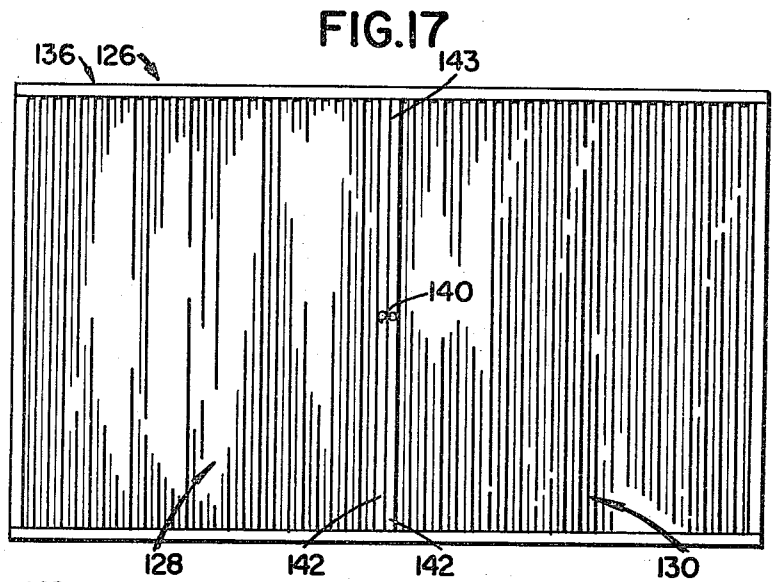
FIG. 17 is a front elevational view of the shade assembly of FIG. 15 in a fully drawn or "closed" conformation.
Figure 16:
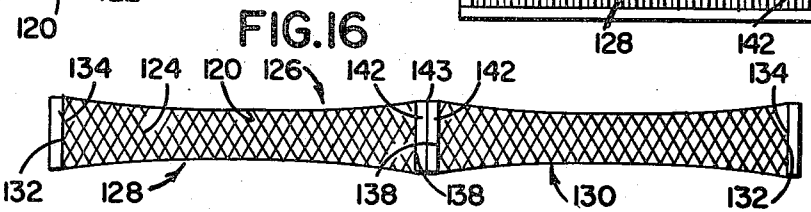
FIG. 16 is a plan view in section of the shade assembly of FIG. 15 in a fully drawn or "closed" conformation.
Figure 15:
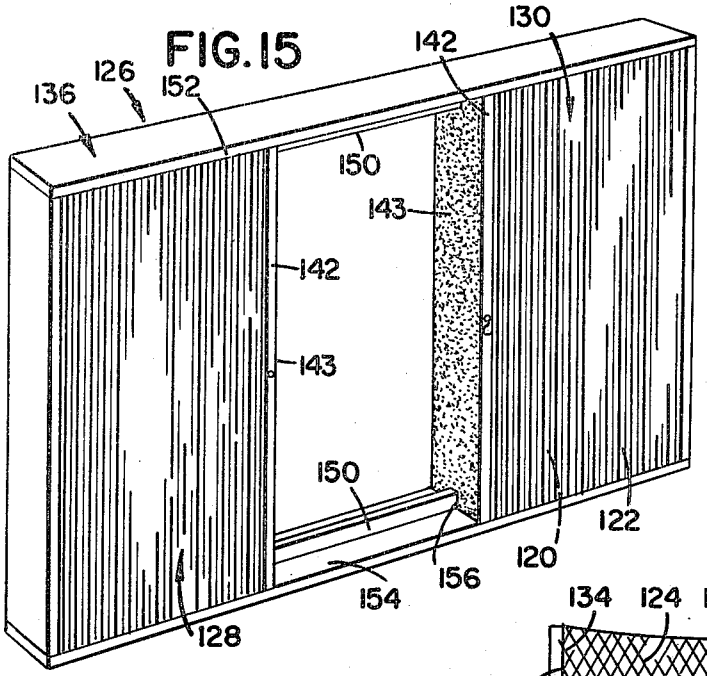
FIG. 15 is a perspective view of a shade assembly having vertically-oriented channels formed in opposed shade body portions shown in a partially drawn conformation.

Referring now to FIGS. 15–20, an embodiment of the invention having vertically oriented channels 120 is shown. The channels 120 are formed from thin sheets 122 of a preferably nonwoven material such as is described herein relative to the sheets 80. The sheets 122 are bonded together along adhesion lines 124 in a manner essentially identical to the formation of the honeycomb structure 78. In essence, the honeycomb structure 78 previously described is simply oriented with the longitudinal axes of the channels disposed vertically in the embodiments of FIGS. 15–20. Shade assembly 126 of FIGS. 15–17 is particularly seen to comprise two separate body portions 128 and 130, each portion 128 or 130 being attached along respective outer vertical edges 132 to facing vertical frame surfaces 134 of a window frame 136 within which the shade assembly 126 is mounted. Leading edges 138 of the body portions 128 and 130 are pulled together medially of the window frame 136 and latched together as seen in FIG. 17 by means of conventional latch structure 140 mounted on end plates 142 to which the leading edges 138 are respectively connected. A sealing material 143 can be disposed on at least one of the end plates 142 so that a better seal is formed therealong when said plates 142 are brought into contact. A strip of foam rubber, sponge, fleece or the like can comprise the sealing material 143 in a compressed position between the end plates 142. As is readily seen in the figures, the vertical channels 120 of the body portions 128 and 130 expand or contract on closing or opening of the shade assembly 126 to provide insulation over the opening defined by the window frame 136.

As can be seen in FIG. 15, sealing slats 150 are respectively disposed along upper and lower horizontal frame members 152 and 154, the guide members 150 being preferably rectangular in cross section and fitting into horizontally disposed slots (not shown in FIG. 15) formed in the respective body portions 128 and 130 along lower horizontal side surfaces thereof. The slots essentially correspond to the slots 40 of the shade body 16 of FIGS. 1–7 and act with the sealing slats 150 to maintain the shade body portions 128 and 130 on a definite path while being drawn or retracted. Further, the sealing slats 150 and the slots formed in the body portion 128 and 130 act in a manner similar to the cooperation of the slots 40 and sealing slats 32 described above to form a convective seal along the horizontal edge portions of the body portions 128 and 130. The end plates 142 also have aligned slots 156 formed at the ends thereof to receive the sealing slats 150 therein. In essence, the structural features and attendant advantages described above relative to the shade assembly 10 apply to the shade assembly 126.

Figure 18:
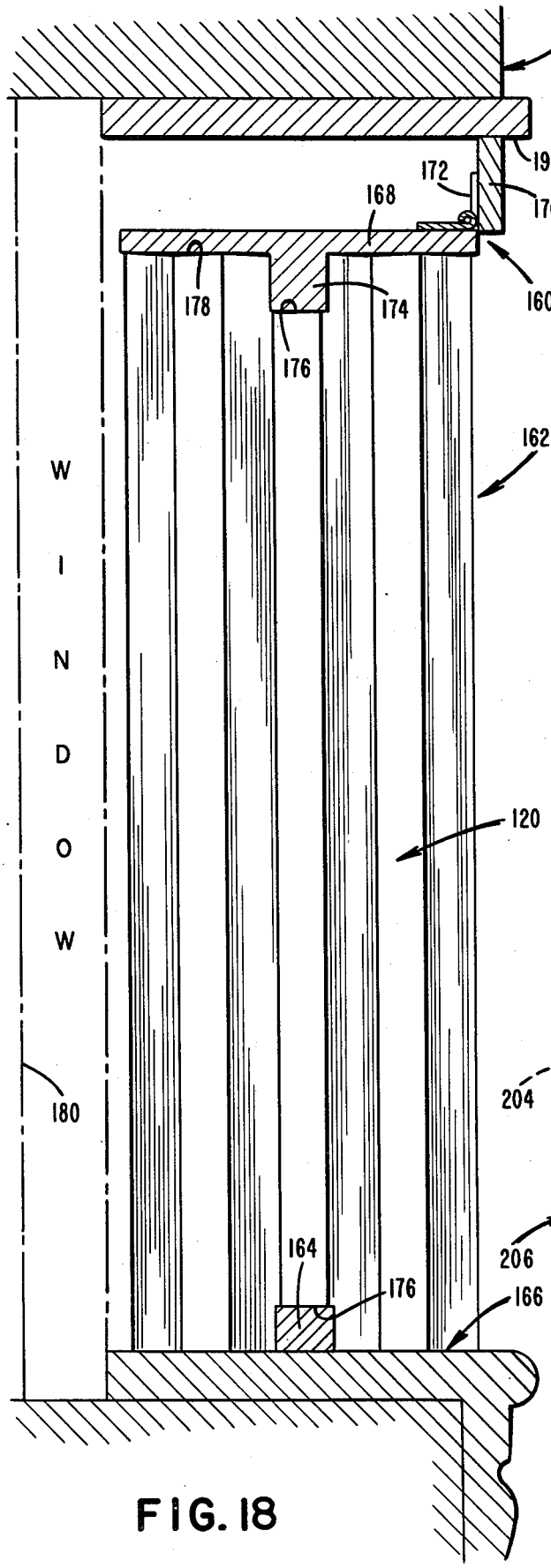
FIG. 18 is an elevational view in section of a shade assembly similar to the embodiment of FIG. 15 and having a "floating" top seal and lower guide member received within horizontal slots formed in the body portions of the shade body, the edges of the slots acting to contact opposing surfaces of the guide member to form a convective air seal.

FIG. 18 illustrates the use of an upper "floating" top seal member at 160 which acts both to guide a shade body 162 formed either of separate body portions or of a single body in the manner of a track in concert with a lower sealing slat 164 and to assist in formation of a convective seal along upper horizontal edges of a shade assembly. The seal member 160 is substantially T-shaped in section and extends essentially along the full upper edge of a window frame 166. One upper leg 168 of the member 160 is mounted to hanger member 170 by means of a hinge 172, the hanger member 170 being fixedly connected to upper horizontal edge 172 of the window frame 166. The member 160 can thus pivot or "float" relative to the shade body 162, in order to more positively maintain "tongue" 174 (sealing slat) of the member 160 within slots 176 formed in upper horizontal side surface 178 of said shade body 162. The slots 176 and the tongue 174 act to provide a convective seal in a manner substantially identical to the seal formed by the slots 40 and the sealing slats 32 described above. The top seal member 160 thus acts to guide the shade body 162 and to seal an air space between the shade body 162 and window pane 180, a stationary sealing slot 182 and the slots 176 on the lower horizontal edges of the shade body 162 acting as aforesaid to guide and seal the shade assembly along the lower horizontal edges thereof. Although not shown, a simple "floating" seal could be formed by the disposition of a layer of fabric or the like attached to the hanger member 170 along horizontal edges thereof and allowed to extend into contact with upper horizontal edges of the shade body.

Figure 19:
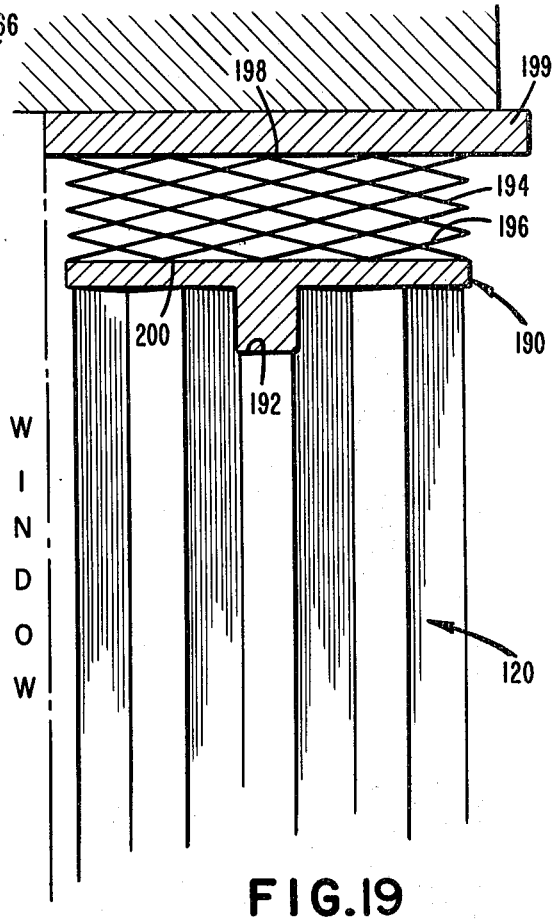
FIG. 19 is an elevational view in section of a shade assembly similar to the embodiment shown in FIG. 15 and having a top seal comprised of honeycomb material.

Referring to FIG. 19, a top seal is formed in an otherwise identical embodiment of the invention by a T-shaped floating top seal member 190 which cooperates with slots 192 formed in body portions of the shade assembly. In this embodiment, the top seal member 190 is held in position and is biased into guiding and sealing contact with body portions of the shade assembly by means of a segment of honeycomb material 194 which exerts a spring-like force on the seal member 190 and thus acts to maintain said seal member 190 in place. The honeycomb structure 194 is formed as is described hereinabove and has longitudinal axes of channels 196 disposed horizontally. The segment of the honeycomb structure 194 typically extends the full width of the window frame and is connected along its upper surface 198 to the window frame itself or to upper plate 199 and is connected along its lower surface 200 directly to upper surfaces of the top seal member 190.

Figure 20:
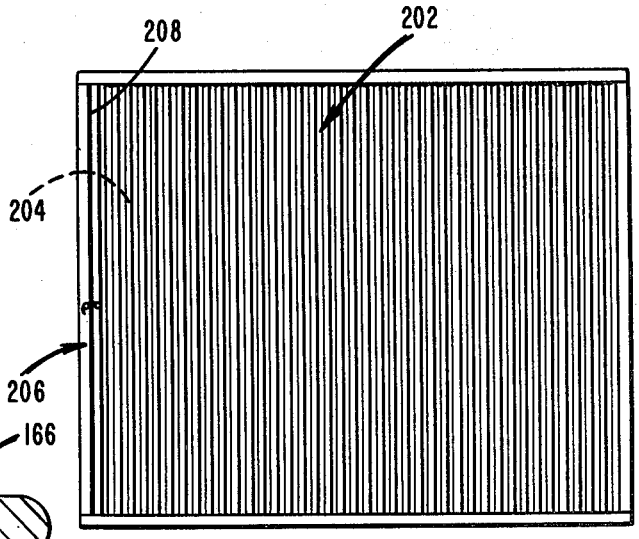
FIG. 20 is a front elevational view of a shade assembly having vertically disposed channels, the shade body being continuous.

FIG. 20 illustrates a further embodiment of the invention wherein shade body 202 has vertically oriented channels 204 formed of a single piece of a honeycomb structure rather than of two portions such as the body portions 128 and 130 of the shade assembly 126 of FIG. 15. It can be readily realized given the description of the embodiments of FIGS. 15–19, that shade body 202 can be guided and sealed in an identical manner, free edge 206 being latched directly to the facing vertical surface of the window frame and sealed thereto by a strip 208 of compressible material in a manner similar to the sealing together of the end plates 142 described above. Shade body 202, as well as the shade assembly 126 described above, can be provided with stationary sealing slats (not shown) which function in a manner substantially identical to the sealing slats 150 as described previously. A floating seal member could alternatively be provided.

Figure 22:
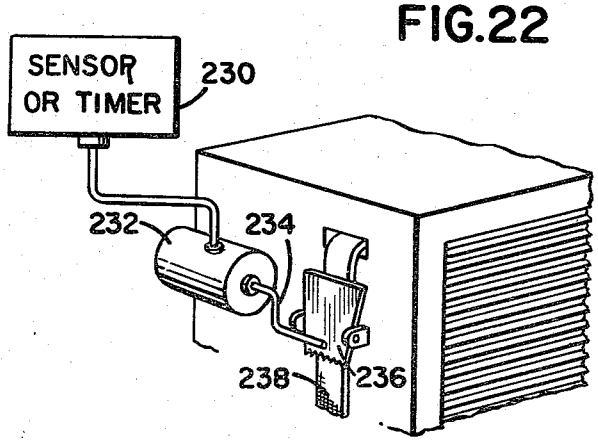
FIG. 22 is an idealized perspective view with portions of structure in diagrammatical form illustrating the condition responsive shade lowering structure of FIG. 25 in a configuration whereby the shade pull cord is held to prevent lowering of the shade.
Figure 21:
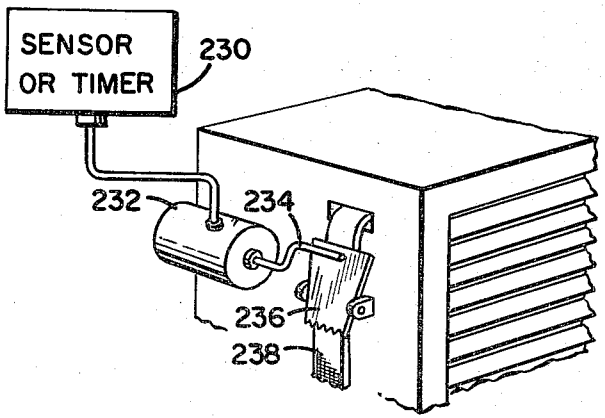
FIG. 21 is an idealized perspective view with portions of structure in diagrammatical form illustrating a condition responsive shade lowering structure in a configuration whereby the shade pull cord is released to allow the shade to be displaced downwardly over a window due to gravity.

Referring now to FIGS. 21 and 22, a shade assembly is seen to be provided with structure for lowering the shade body in response to a given condition such as the time of day, light, temperature or the like. A condition sensor 230, such as a timer, activates a solenoid 232 having a cam arm 234 formed therein and being displaceable with the solenoid 232. A cord-holding pawl 236, such is commonly used for blinds and similar structures, holds a pull cord 238 to maintain the shade body in the raised configuration. On activation of the solenoid 232 by the condition sensor 230, the cam arm 234 engages the pawl 236 and releases the pull cord, the weight of the shade body, particularly when attached to a draw bar, causing the shade body to lower to a "closed" configuration. Thus, the shade body can be manually raised in the morning of a winter day to admit energy through the window, the shade body being automatically lowered as aforesaid at a given time in response to the advent of darkness to reduce heat outflow through the window at night. It is of course apparent that the shade body could be also raised in response to a sensed or timed condition.

Figure 23:
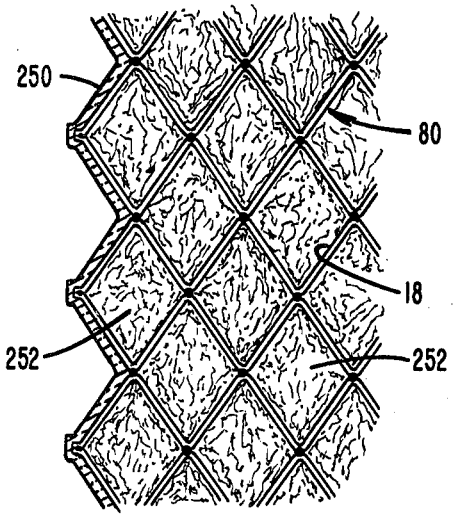
FIG. 23 is a detailed side elevational view in section illustrating a reflective coating optionally disposable on surfaces of the shade adjacent a window.
Figure 24:
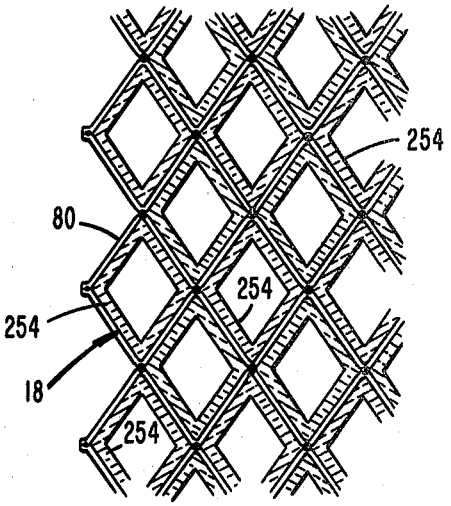
FIG. 24 is a detailed side elevational view in section illustrating a coating on internal surfaces of the shade, the coating having low emissivity in the far infrared region of the electromagnetic spectrum.

As seen in FIG. 23, the surfaces of those portions of sheets such as the sheets 80 which form the honeycomb structure 78 of FIGS. 10–12, and which face the window can be coated with a layer 250 of material having high reflectivity in the ultraviolet and visible portions of the electromagnetic spectrum. A layer of white paint, for example, would provide such capability. The layer 250 acts as an effective reflector of solar radiation during summer months. The reflectance of the layer 250 and the insulative capability of the channels 18 combine to reduce solar-induced heat gain, thereby reducing air conditioning costs during warm weather. The channels 18 can be caused to contain a lightweight fibrous material 252, such as cotton or synthetic elongated strands of glass-like fibers, the material 252 providing increased insulative capability. The material 252 acts to obstruct air flow within the channels 18, random disposition of the material 252 within the channels also acting to form a multiplicity of air-entrapping cells within the channels 18. As seen in FIG. 24, the insulating efficiency of channels 18 can be improved by providing a thin layer 254 on the inner surfaces of the channels, the layer 254 being comprised of a material having a low emissivity in the far infrared region of the electromagnetic spectrum. Metals such as aluminum are particularly useful for this purpose. U.S. Pat. No. 3,130,112, issued to the present inventor, describes materials suitable for forming such layer 254 and is incorporated herein by reference.

Prior embodiments of the invention have essentially been described as being disposable within that recess in an interior wall of a building which is usually referred to as a window "well" and which is bordered by a window frame. Windows or similar thermal openings can also be fitted with embodiments of the invention which are disposed along the interior wall of the building and "outside" of the window well as is shown in FIGS. 29 and 30. Thus, in FIG. 25, a shade body 260 is seen to have a "width" which is greater than the width of window frame 262. The shade body 260 is seen to comprise horizontal channels 264 and to be sealed effectively against walls 266 of the building by sealing members 268 which are strip-like sealing slats and which can also serve a guiding function. The sealing members 268 are T-shaped in section and each comprise a back plate 270 which is mounted flushly against wall 266, a leg portion 272 extending perpendicularly from the back plate 270 and terminating in a bulbous portion 274. The leg portion 272 and bulb-like portion 274 are received within correspondingly shaped slots 276 formed in the shade body 260. The edges of the material forming the shade body 260 which oppose the leg portion 272 and bulb-like portion 274 also "neck down" to create a more effective seal in the same manner as is described above relative to FIGS. 1–7 and as also occurs relative to the vertical channel embodiments of the invention. The sealing members 268 thus provide a sealing function and also prevent, due particularly to the bulb-like portion 274, displacement of the shade body 260 outwardly of the window frame 266.

Figure 26:
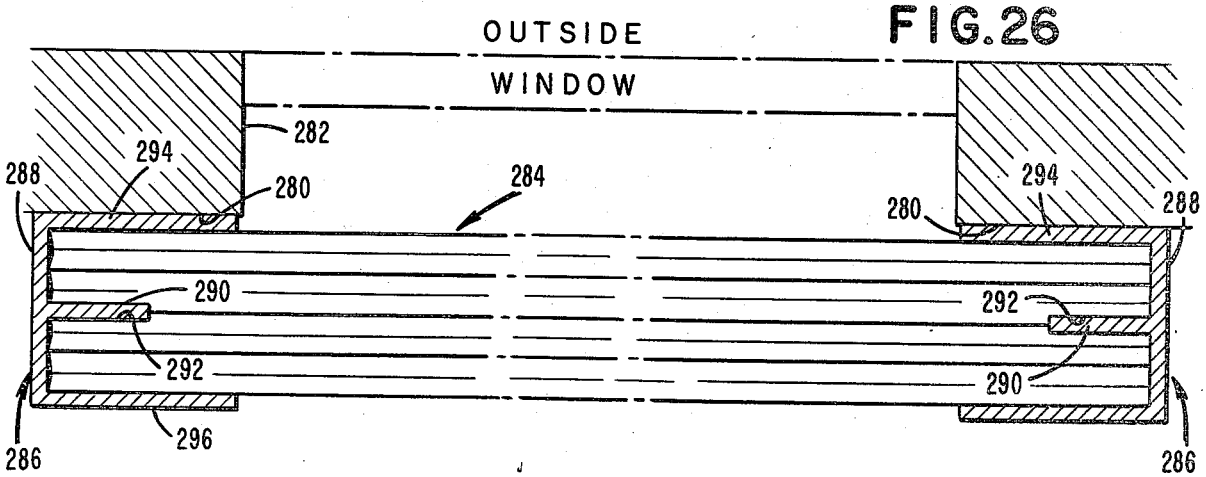
FIG. 26 is a plan view in section of a further shade mounting structure wherein the shade body is mounted against wall surfaces adjacent a window.

Referring now to FIG. 26, a similar structure is seen to be mounted along walls 280 of a window frame 282, shade body 284 being effectively mounted within side sealing and framing member 286. The members 286 are E-shaped in section, body plate 288 and sealing slat plate 290 essentially serving the same functions as the T-shaped side frames 23 of FIGS. 1–7, sealing, including the necking down of the honeycomb structure of the shade body 284, occurring with slots 292 formed in the vertical edge face of the shade body 284. Interior and exterior end plates 294 and 296 act respectively to mount the members 286 to the walls 280 and to maintain the shade body 284 in a desired location relative to the walls 280.

Figure 25:
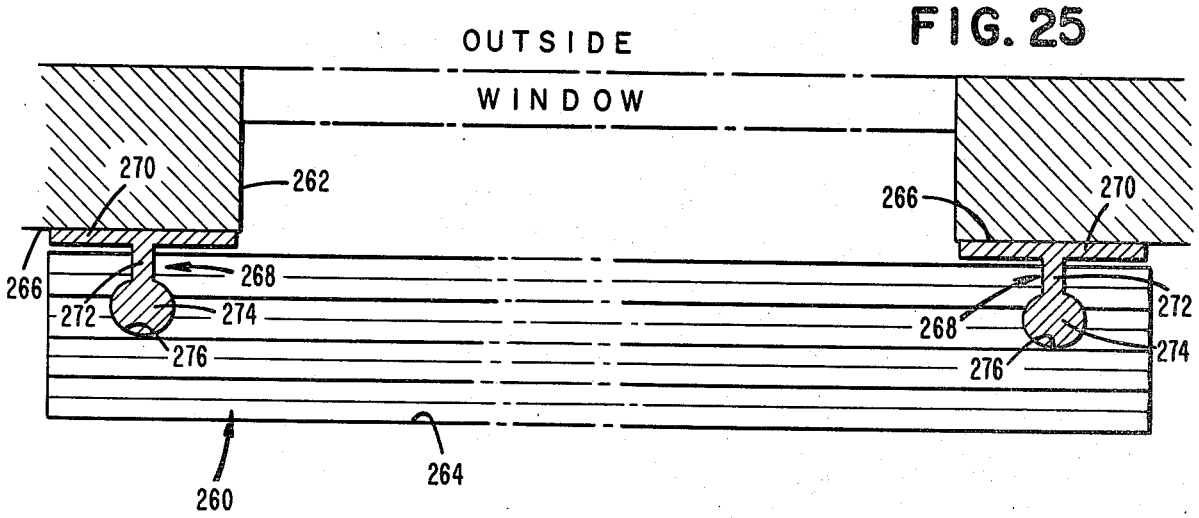
FIG. 25 is a plan view in section of a shade mounting structure wherein the shade body is mounted against wall surfaces adjacent a window.

In the embodiments of FIGS. 25 and 26, structure similar to that shown in FIGS. 1–7 would be used at the upper horizontal sides of the shade bodies 260 and 284 for storage and the like while sealing of lower horizontal of the respective shade bodies can be accomplished merely by pulling the shade bodies below the lower level of the window frames or by providing other sealing structure which can be similar to the compressible materials described herein.

The advantage of the present invention can clearly be seen when it is realized that the winter heat loss through windows in typical private residences is approximately 18% for an uninsulated home and 32% for an insulated home when solar intake is not considered. Commercial buildings have a greater range of variation with predominantly glass exterior buildings having a heat loss through windows which can equal 60% to 70% of total heating costs. While presently available window shading devices can provide some reduction in heat loss which vary from 7% with conventional Venetian blinds and draperies to 40% with metallized, inside casement roller shades, they do not provide shading devices which can be sufficiently effective to provide truly significant reduction in heat loss through windows. The present structures have the demonstrated capability of reducing heat flow through windows by from about 65% to about 80%.

Independent testing performed by the Electrical Testing Laboratories, Inc. of Cortland, N.Y., provided the following results:

TEST DESCRIPTION

The Thermal Transmittance (U-Value) of the honeycomb shade of this invention was determined by employing ETL designed calorimeter (Guarded Hot Box) in general accordance with ASTM Standard C 236 on a window 3 feet by 4 feet fixed light of 3/6" clear glass.

Results of Thermal Transmittance Tests

| | Control Uncovered Window | Honeycomb Shade |
|---|---|---|
| Temperatures, °F. | | |
| Indoor ambient-air | 68.2 | 68.6 |
| Outdoor ambient-air | 18.3 | 18.0 |
| Interior Glass Surface | 29.6 | 20.1 |
| Heat input, BTU/hr | 635 | 174 |
| Calorimeter Heat Loss Correction, BTU/hr | 0 | −3 |
| Test Buck Heat Loss Correction, BTU/hr | 23 | 24 |
| Net Heat Input, BTU/hr | 612 | 147 |
| Nominal Area of Sample, $ft^2$ | 12.0 | 12.0 |
| Air Temperature Difference from Warm Side to Cold Side, °F. | 49.9 | 50.6 |
| HEAT-TRANSFER COEFFICIENTS* | | |
| Overall U, BTU/hr-$ft^2$ deg. F | 1.02 | 0.24 |
| Overall R. Hr-$ft^2$ deg. F/BTU | 0.98 | 4.13 |
| Summary of Results | | |
| Less Heat Lost** | — | 76.5 |
| More Heat Retained*** | — | 325.0 |

*Heat transmitted through material measured from warm air to cold air; this is not the same Thermal Conductance "C: which is measured from warm surface to cold surface.
**Control used as base.
***Honeycomb shade used as base.

The honeycomb shade utilized in the test was a 6-channel, 1" mesh honeycomb configured and sealed as described in FIGS. 1–7. This shade structure configured according to the invention reduced the heat loss relative to an uncovered window by 76.5% as indicated in the test results. When considering the above data in terms of the R value of the tested shade, i.e., the resistance to heat flow, further test showed that, when compared to an R value of 1.17 for a conventional shade, the honeycomb shade had an R value of 4.13. The present shade structure was therefore 3.5 times more effective in reducing heat loss than a conventional shade.

Further testing conducted in an actual use situation was conducted by comparing the energy used for heating in two sets of two rooms essentially identical in a motel, two of the rooms having the shade of FIGS. 1–7 installed on all windows while the other two rooms were without the shade. The rooms were all electrically heated, were north facing, and were rented and occupied equally during the test. The results of the test is given in two phases as follows:

| PHASE 1 Winter | February 2 to May 5 | 93 days |
|---|---|---|
| Average KWH use per room with shade | | 442 |
| Average KWH use per room without shade | | 832 |

Difference—390 KWH less in the room with the shade

KWH AND DOLLAR SAVINGS ON AN ANNUAL BASIS (Projected)

For Heating Season 963 KWH saved per window
For Cooling Season 247 KWH saved per window

| KWH × $/KWH | = | Savings | |
|---|---|---|---|
| 963 × 0.0534 | = | $51.42 | |
| 247 × 0.0887 | = | $21.91 | |
| | | $73.33 | savings per window per year |

The window area in the room evaluated are 2.9 square yards. Therefore, the savings per square yeard of window area would be $25.29. Calculated projections are based upon a 6,000 degree day winter and a 60 day summer requiring air conditioning.

While the invention has been specifically described relative to several preferred embodiments thereof, it is to be understood that some changes and modifications can be made therein without departing from the scope of the invention.

What is claimed is:

1. A drawable shade structure for reducing heat flow through a window or other thermal opening, comprising:

a shade body drawable over the window and collapsible into a reduced storage volume relative to its extended volume, the shade body comprising opposite walls of thin, sheet-like layers of flexible and resilient material joined together along spaced parallel adhesion lines, the lines being disposed between adjacent layers of material on opposite sides thereof to thereby form a plurality of contiguous and parallel channels disposed regularly throughout the shade body; and strip-like sealing slats disposed on surfaces of the framing portions of the window which oppose edge portions of the shade body for sealing the edge portions of the shade body against the framing portions of the window to reduce convective air flow, the two opposite edge portions of the shade body each having a slot-like recess formed therein which extends essentially the full length of the edge portions, the recesses respectively receiving the edge portions and portions of lateral surfaces of the sealing slats thereinto, with free edges of the sheet-like layers which border and define the recesses being flexed against and contacting the lateral surfaces of the sealing slats when the shade body is extended to cover the window, and the contact between the free edges of the layers and the lateral surfaces of the slats forming an effective convective seal.

2. The shade structure of claim 1 wherein the said free edges of the sheet-like layers which contact the lateral surfaces of the sealing slats are sufficiently flexed so that portions of the said free edges lie flat against said lateral surfaces.

3. The shade structure of claim 1 wherein the longitudinal axes of the channels are disposed in parallel relation to the plane in which the window is essentially disposed.

4. The shade structure of claim 1 wherein the channels are horizontally disposed within the shade body, the shade body having a vertical direction of motion on collapse and extension.

5. The shade structure of claim 1 and further comprising bottom sealing means to seal the edge portion of the shade body against the framing portions of the window about the bottom horizontal edge of said shade body to entrap an air space between the shade body and the window.

6. The shade structure of claim 5 wherein the bottom sealing means comprises a strip of a fibrous material disposed between the bottom edge portion of the shade body and the framing portion of the window to seal therebetween.

7. The shade structure of claim 1 and further comprising:

means for sensing a given condition and for producing a signal indicative of the existence of the condition; and, means responsive to the signal for adjusting the position of the shade body relative to the window.

8. The shade structure of claim 1 wherein the ends of the sheet-like material forming the side edges of the shade body have contiguous contact with opposed surfaces of the framing portions of the window when the shade body is extended to a position covering the window.

9. The shade structure of claim 1 wherein the sealing slats form seals disposed along side edge surfaces of the shade at locations based further from that surface of the shade body facing the window than from the opposite surface of said shade body which faces an interior environmental space.

10. The shade structure of claim 1 wherein the recesses in the shade body are disposed at locations nearer the surface of the shade body which faces an interior environmental space, the slats and the recesses thus cooperating to facilitate formation of seals nearer to said interior environmental space than to the window.

11. The shade structure of claim 1 and further comprising a framework within which the shade body is mounted and moves and against which the sealing means seal the shade body, the framework and associated shade body mounted for movement therein being disposable in a unitary fashion within a window well to insulate the window opening.

12. The shade structure of claim 1 and further comprising a framework within which the shade body is mounted and moves and against which the sealing means seal the shade body, the framework and associated shade body mounted for movement therein being disposable in a unitary fashion within a window well to insulate the window opening, the sealing slats extending from interior side surfaces of the framework toward and into the recesses to facilitate formation of a seal and being formed integrally with portions of the framework facing the edge portions of the shade body.

13. The shade structure of claim 1 and further comprising at least one pull cord which extends through the shade body and connects to the edge of the shade body which is displaced axially of the shade body on movement of the shade body, the pull cord also serving to guide the shade body.

14. The shade body of claim 1 and further comprising stationary guide members extending through apertures in the shade body and mounted to framing structure on opposite ends of the shade body along the direction of travel of the shade body, the shade body being maintained in a desired path along the guide members.

15. The shade structure of claim 1 and further comprising a draw bar attached to the lower end of the shade body, the draw bar contacting the lower horizontal surfaces of the framing portions of the window when the shade body is fully extended, contact between the draw bar and said horizontal surfaces acting to facilitate formation of a seal therebetween.

16. The shade structure of claim 15 further comprising at least one elongated, resilient blade extending substantially the length of the draw bar on the undersurface thereof, the elongated side edge of the blade being connected to the draw bar and the free elongated edge of the blade extending toward the lower horizontal surface of the framing portion of the window and contacting said horizontal surface when the shade body is fully extended, thereby facilitating formation of a seal therebetween.

17. The shade structure of claim 1 wherein the shade body is comprised of two separate body portions, each body portion being mounted along an outermost end to a respectively oppositely facing framing portion of the window, the opposite free ends of the body portions being extendable across the window to meet medially of the window.

18. The shade structure of claim 1 wherein the sealing means comprise along the upper horizontal edge surface of the shade body a plate member hinged for pivoting movement to upper framing portions of the window, the plate member having a sealing slat formed on an inner face thereof, the slat extending toward the shade body and being received within a horizontal edge surface of the shade body, portions of the plate member being capable of vertical displacement relative to the shade body to facilitate seating of the sealing slat within the recess.

19. The shade structure of claim 1 further comprising means for mounting the shade body over the window for movement along faces of the walls bordering the window, the shade body being exposed exteriorly of the window well.

20. A drawable shade structure for reducing heat flow through a window or other thermal opening, comprising: a shade body drawable over the window and being collapsible into a reduced storage volume relative to the extended volume, the shade body comprising a honeycomb-like structure defining a plurality of contiguous channels disposed throughout the shade body, the honeycomb-like structure being formed of regular aligned layers of thin, flexible and resilient sheets, the sheets being interconnected by regularly spaced adhesion lines which extend parallel to each other and essentially parallel to the surface of the window, the adhesion lines connecting adjacent sheets being spaced by a distance d on oppositely facing surfaces of any two adjacent sheets, the opposite surface of any one of the two adjacent sheets and the surface of the next sheet adjacent thereto having adhesion lines spaced apart by the distance d and being offset by a distance 0.5 d relative to the adhesion lines between oppositely facing surfaces on the first-mentioned adjacent sheets, the adhesion lines connecting a given sheet to adjacent sheets on opposite surfaces thereof to thereby alternate across the sheet from one surface to the other opposite surface in a regular manner, the channels being defined and formed by facing, uninterrupted surface portions defined on the oppositely facing surfaces of any two adjacent sheets by adjacent adhesion lines, said surface portions comprising walls of the channels which collapse and expand on collapse or expansion of the shade body such as occurs on movement of the shade body respectively into a stored conformation or into an extended conformation; both ends of each sheet being interconnected to the ends of the adjoining sheets by said adhesion lines to form parallel, outwardly directed projections which prevents the outer walls of the shade from folding inwardly when the shade is collapsed, and means for sealing edge portions of the shade body against framing portions of the window to reduce convective air, said sealing means comprising strip-like sealing slats of substantially rigid material disposed on surfaces of the framing portions of the window which oppose edge portions of the shade body, the two opposite edge portions of the shade body each having a slot-like recess formed therein for receiving end portions of lateral surfaces of the slats thereinto, free edges of the sheets which border and define the recesses being spaced from the lateral surfaces of the sealing slats when the shade body is fully collapsed, the free edges being in sealing contact with the lateral surfaces of the slats on extension of the shade body, the contact between the free edges of the honeycomb-like structure within the recesses and the lateral surfaces of the slats forming an effective convective seal.

21. The shade structure of claim 20 wherein the channels are horizontally disposed within the shade body when in an operative position, the recesses being formed in the vertical edge surfaces of the shade body and the slats being disposed on the vertical surfaces of the framing portions of the window.

22. The shade structure of claim 20 wherein the channels are vertically disposed within the shade body when in an operative position, the recesses being formed in the horizontal edge surfaces of the shade body and the slats being disposed on horizontal surfaces of the frame portions of the window.

* * * * *